US010617224B2

(12) United States Patent
Codos

(10) Patent No.: US 10,617,224 B2
(45) **Date of Patent: *Apr. 14, 2020**

(54) MATTRESS

(71) Applicant: Richard Codos, Warren, NJ (US)

(72) Inventor: Richard Codos, Warren, NJ (US)

(73) Assignee: Sleepovation LLC, East Hanover, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/508,011

(22) Filed: Jul. 10, 2019

(65) Prior Publication Data

US 2019/0343295 A1 Nov. 14, 2019

Related U.S. Application Data

(63) Continuation-in-part of application No. 16/222,028, filed on Dec. 17, 2018, now Pat. No. 10,368,655, which is a continuation of application No. 14/801,790, filed on Jul. 16, 2015, now Pat. No. 10,188,219, which is a continuation-in-part of (Continued)

(51) Int. Cl.

| | |
|---|---|
| ***A47C 27/06*** | (2006.01) |
| ***A47C 27/05*** | (2006.01) |
| ***A47C 27/04*** | (2006.01) |

(52) U.S. Cl.

CPC ..... *A47C 27/064* (2013.01); *A47C 27/056* (2013.01); *A47C 27/04* (2013.01); *A47C 27/05* (2013.01)

(58) Field of Classification Search

CPC ..... A47C 23/04; A47C 23/043; A47C 23/064; A47C 23/065; A47C 27/04; A47C 27/05; A47C 27/053; A47C 27/056; A47C 27/06; A47C 27/062; A47C 27/064; A47C 27/14; A47C 27/148; A47C 27/15

USPC ..... 5/239, 241, 243, 245, 642, 654.1, 655.7, 5/655.8, 716, 720, 727, 728

See application file for complete search history.

(56) References Cited

U.S. PATENT DOCUMENTS

| | | | |
|---|---|---|---|
| 19,350 | A | 2/1858 | Crossman |
| 685,160 | A | 10/1901 | Marshall |

(Continued)

FOREIGN PATENT DOCUMENTS

| | | | |
|---|---|---|---|
| CN | 103610349 | A | 3/2014 |
| EP | 2789267 | B1 | 5/2015 |

(Continued)

*Primary Examiner* — Robert G Santos

(74) *Attorney, Agent, or Firm* — Steven N. Fox, Esq.

(57) ABSTRACT

The present invention is a mattress comprising a first layer of cushion members secured to a layer of coil pockets. The layer of coil pockets comprises first and second coil pockets. Each of the first and second coil pockets comprise a pocket and a coil spring disposed in the pocket. The first layer of cushion members comprises an attachment member and first and second cushion members engaged with said attachment member. The attachment member is engaged with the layer of coil pockets such that the first and second cushion members act directly upon the first and second coil pockets, respectively. The first cushion member is free standing from the second cushion member thereby causing a pumping action to occur upon depression of the first cushion member and circulation of air.

18 Claims, 29 Drawing Sheets

Related U.S. Application Data application No. 14/695,063, filed on Apr. 24, 2015, now Pat. No. 9,661,932.

(60) Provisional application No. 62/134,406, filed on Mar. 17, 2015.

(56) References Cited

U.S. PATENT DOCUMENTS

| | | | | |
|---|---|---|---|---|
| 1,192,510 | A | 7/1916 | Fischmann | |
| 1,576,738 | A | 3/1926 | Fuld | |
| 1,834,546 | A | 12/1931 | Micon | |
| 1,906,893 | A * | 5/1933 | Young et al. | A47C 27/05 5/716 |
| 2,236,007 | A | 3/1941 | Oldham | |
| 2,983,236 | A | 5/1961 | Thompson | |
| 3,031,690 | A | 5/1962 | Ramsay | |
| 3,122,829 | A | 3/1964 | Schaad | |
| 3,160,894 | A | 12/1964 | Frey | |
| 3,166,768 | A | 1/1965 | Cunningham | |
| 3,191,197 | A * | 6/1965 | Frey | A47C 27/04 5/243 |
| 3,462,779 | A | 8/1969 | Thompson | |
| 4,439,977 | A | 4/1984 | Stumpf | |
| 4,566,926 | A | 1/1986 | Stumpf | |
| 4,899,404 | A | 2/1990 | Galumbeck | |
| 5,070,560 | A | 12/1991 | Wilkinson | |
| 5,231,718 | A * | 8/1993 | Blaha | A47C 27/088 5/719 |
| 5,783,278 | A | 7/1998 | Nishimura | |
| 5,868,383 | A | 2/1999 | Codo | |
| 6,041,459 | A | 3/2000 | Nunez | |
| 6,317,912 | B1 | 11/2001 | Graebe | |
| 6,397,418 | B1 | 6/2002 | Stjerna | |
| 6,490,744 | B1 | 12/2002 | Schulz, Jr. | |
| 6,523,812 | B1 | 2/2003 | Spinks | |
| 6,804,847 | B2 * | 10/2004 | Grothaus | A47C 27/04 5/655.8 |
| 6,948,205 | B2 | 9/2005 | Van Der Wurf | |
| 7,082,635 | B2 | 8/2006 | Barman | |
| 7,845,035 | B2 | 12/2010 | Letton | |
| 8,181,296 | B2 | 5/2012 | Rawls-Meehan | |
| 8,266,745 | B2 | 9/2012 | Mossbeck | |
| 8,474,078 | B2 | 7/2013 | Mossbeck | |
| 8,932,692 | B2 | 1/2015 | Pearce | |
| 9,661,932 | B2 * | 5/2017 | Codos | A47C 27/064 |
| 9,949,571 | B2 * | 4/2018 | Codos | A47C 27/064 |
| 10,098,474 | B2 | 10/2018 | Hager | |
| 10,188,219 | B2 * | 1/2019 | Codos | A47C 27/064 |
| 10,368,655 | B2 * | 8/2019 | Codos | A47C 27/064 |
| 2003/0217413 | A1 | 11/2003 | Grothaus | |
| 2007/0044245 | A1 | 3/2007 | Bryant | |
| 2009/0089933 | A1 | 4/2009 | Lettton | |
| 2010/0325806 | A1 | 12/2010 | Letton | |
| 2016/0045034 | A1 | 2/2016 | Hager | |
| 2016/0270545 | A1 * | 9/2016 | Codos | A47C 27/064 |
| 2016/0270546 | A1 * | 9/2016 | Codos | A47C 27/064 |
| 2017/0258242 | A1 * | 9/2017 | Codos | A47C 27/056 |
| 2019/0150630 | A1 * | 5/2019 | Codos | A47C 27/07 |
| 2019/0183253 | A1 * | 6/2019 | Codos | A47C 27/064 |
| 2019/0216241 | A1 * | 7/2019 | Codos | A47C 21/046 |
| 2019/0343295 | A1 * | 11/2019 | Codos | A47C 27/064 |
| 2019/0380503 | A1 * | 12/2019 | Stjerna | A47C 27/064 |

FOREIGN PATENT DOCUMENTS

| | | |
|---|---|---|
| GB | 2452602 | 11/2009 |
| WO | WO1981002384 | 9/1981 |
| WO | WO1991010387 | 7/1991 |
| WO | WO2002039853 | 5/2002 |
| WO | WO2009117631 | 9/2009 |
| WO | WO2014080302 | 5/2014 |
| WO | WO2014166927 | 10/2014 |

* cited by examiner

MATTRESS

CROSS-REFERENCE TO RELATED APPLICATIONS

This application claims priority to and is a continuation of U.S. Utility application Ser. No. 16/222,028 filed on Dec. 17, 2018, now U.S. Pat. No. 10,368,655, that claims priority to U.S. Utility application Ser. No. 14/801,790 filed on Jul. 16, 2015, now U.S. Pat. No. 10,188,219, that claims priority to U.S. Utility application Ser. No. 14/695,063 filed on Apr. 24, 2015, now U.S. Pat. No. 9,661,932, that claims priority to U.S. Provisional Application Ser. No. 62/134,406 filed on Mar. 17, 2015, now expired, all of which are hereby incorporated into this specification by reference in their entirety.

BACKGROUND OF THE INVENTION

Referring to FIGS. 1 and 2, a conventional mattress 50 generally has a layer of pocket coil springs 57, alternatively know as Marshall Type Springs, engaged with a base 52. Mattress 50 further has cushion layers 53 and 54 disposed above pocket coil springs 57 and a mattress ticking cover 51. First described in U.S. Pat. No. 685,160, a Marshall Type Spring is a coil spring 56 encased in a material pocket 55. The pocket coil assemblies are made by inserting coil springs 56 into respective fabric coil pockets 55 that are usually strung together as a continuous pocket coil strip.

U.S. Pat. No. 2,236,007 discloses a Marshall Type Spring having fiber stuffing added into the core of the pocket coil spring to help absorb forces placed upon the actual pocket coil spring by absorbing some of those forces in the fiber filling material.

U.S. Pat. No. 8,266,745 discloses a Marshall Type Spring employing a fill material, including foam or fiber, residing in the pocket with the spring coil, to reduce and eliminate noise and prevent the fabric that surrounds the spring from getting sucked inside the pocket when a person gets onto or off of the bed.

What most pocket coil mattresses have in common is that the coil spring, contained in an individual fabric pocket, lies under a sheet or multiple sheets, of padding and cushioning material that provide initial loading softness, a softer sleeper feel, help in reducing localized high pressure interface points, reduce the sensation of lying directly on a metal spring, and help conform to body contours. Mattresses of this type are often flipped at some time interval to help mitigate and eliminate the problems associated with getting body imprints in one or more of the cushioning layers from the sleeper repeatedly lying in a similar position night after night.

Referring to FIG. 3, another shortcoming of having a single or multiple sheets of cushioning material 53 above a layer of pocket coils 58 is that compressive forces caused by the weight of a body 49 ("sleeper compressive forces") are transmitted in the plane of cushioning material 53, a plane that is generally at right angles and perpendicular to the vertical plane of the pocket coil unit. This results in the sleeper compressive forces being transferred laterally to adjacent pocket coils even though those same coils might not be subjected to direct sleeper forces. This creates an indentation well 60 that causes the sleeper to be drawn into the core of mattress 50 rendering mattress 50 uncomfortable for sleeping.

An additional problem of the indentation well effect occurs for a second sleeper utilizing the same mattress at the same time as the primary sleeper. The second sleeper can often be subjected to the indentation well effect of the primary sleeper and be subjected to forces that draw that sleeper into the same sleep space as the primary sleeper. Obviously, the inverse is also true and the primary sleeper can be drawn into the indentation well effect created by the secondary sleeper. Both of these situations result in a situation in which neither sleeper is able to get comfortable in his or her own space due to shortcomings in the way that sheet cushioning material behaves in a current mattress configuration.

A further shortcoming of the sheet cushioning above the pocket coil is that the sheet cushioning material takes on a trampoline effect when loaded from above. Rather than just acting as a cushioning material to provide initial loading softness, a softer sleeper feel, help in reducing localized high pressure interface points, and help in conforming to body contours, the sheet cushioning is often additionally acting like a trampoline and exhibiting its own spring effect. The magnitude of the trampoline effect usually correlates closely with the tensile strength of the cushioning material. The cushioning material is being held in place above pocket coil springs that are not being compressed and is resisting downward defection in areas that are being subjected to compressive forces due to the lateral, in plane, tensile strength of the material. In essence, the sheet cushioning material is acting like a spring unit in its own right due to the tensile strength trampoline effect. This effect is often at odds with the desire of the cushioning material to provide an initial softness to the sleeper. Concerning hospital and nursing home mattresses, a significant problem concerns patients developing decubitus ulcers from increased mattress interface pressures. A goal of the sheet cushioning above a pocket coil core in a hospital mattress is to reduce decubitus ulcer formation by reducing localized high patient interface pressures. However, the trampoline effect exerted by the sheet cushioning layers above the coil unit works to adversely impact this goal.

An added deficiency associated with sheet cushioning above the pocket coil concerns delivery of the mattress. It is well known within the industry that mattresses are normally shipped in a flat configuration in either a horizontal or vertical orientation. Bending the mattress during initial delivery and setup often results in mattresses being damaged and returned. Often the failure mechanism within the mattress is the result of the sheering, permanent dislodging, or deformation of the sheet cushioning material. Furthermore, the need to ship mattress in a flat orientation adds to both the expense and logistics involved in mattress shipping. Often it requires two men and a truck to deliver a mattress to a consumer. It would be inherently advantageous to be able to roll up and compress mattresses for shipping and eliminate the costs associated with shipping a flat mattress. Additionally, the cost of storage in terms of floor space for both the manufacturer and retailer would be greatly reduced if the mattress could be stored in a rolled up and compressed format.

An existing problem when sleeping on different sheeted cushioning materials, especially different types of foam including, but not limited to, polyurethane, latex, and memory foam, is that they have a tendency to cause the sleeper to feel uncomfortably warm or hot when lying on the mattress. This is partially due to the fact that many of these sheeted cushioning materials have insulating properties that restrict body cooling for those sleeper's body parts that are in direct contact with the mattress. Couple this property with the very nature of a sheet of cushioning material's inhibition of airflow through or around the cushioning material makes the cooling problem worse. The inability of a sleeper to properly regulate their temperature, coupled with the fact that a sleeper's wake-up mechanism is partially triggered via internal temperature regulation, can make the inclusion of sheeted cushioning materials in pocket coil mattresses a significant factor in poor sleep quality associated with the mattress.

One of the major causes of mattress failure is a degradation of the sheet cushioning materials. This is a direct result of fatigue softening that is particularly dominant in sheet foam cushioning materials that are subjected to shear loads consistent with sleeper forces exerted on the mattress. Over time and successive loading, the foam starts to lose its ability to resist compression. This degradation of the sheet cushioning materials has led mattress manufacturers to recommend flipping the mattress to mitigate and delay this degradation.

The sheet cushioning also acts to trap dust, dust mites, and potentially other microorganisms. Over an extended period of time this can become a serious health hazard, especially to those individuals who are highly allergic or immunosuppressed. Additionally, hospitals and nursing homes mitigate this problem by covering the mattresses with barrier fabrics.

SUMMARY OF THE INVENTION

One object of the present invention is to provide a mattress that was not prone to formation of indentations.

Another object of the present invention was to develop a mattress that allows air circulation in the core of the mattress providing a cooler mattress for sleeping.

Another object of the invention was to develop a mattress having pocket springs that allow the softness or hardness of the mattress to be selectively controlled.

Another object of the present invention was to develop a mattress that could be easily fabricated as a one sided or two sided mattress and with potential different comfort profiles for each side.

Another object of the invention was to develop a mattress that better isolates sleeper movements.

Another object of the invention was to develop a mattress that eliminates sheet cushioning layers that are subject to shear forces from sleeper compressive loads and their resultant premature failure resulting in a longer life mattress.

Another object of the invention was to develop a mattress that replaces the sheet cushioning with individually encased foam cushion pockets. Since the cushioned pockets are individually encased in a fabric, and the cushion pockets are inherently impervious to trapping dust, dust mites, and other microorganisms, the health hazards associated with sheet cushioning materials on conventional mattresses are substantially reduced.

Another object of the invention was to develop a mattress that reduces the quantity of cushioning material from between 20% to 25% relative to an existing pocket coil mattress that utilizes sheet foam cushioning material, thereby reducing corresponding cost and weight associated with the additional sheet cushioning material. This is accomplished by utilizing the improved pocket coil spring that has cushioning material that only lies directly above the spring unit in the cushioning pocket.

Another object of the invention was to develop a mattress that eliminates sheet cushioning layers that have been linked to the development of decubitus ulcers in patients in nursing homes and hospitals.

Another object of the present invention was to develop a machine and method of constructing pocket springs each comprising a coil pocket and a cushion pocket.

In a first embodiment, the present invention is a mattress comprising a first layer of cushion members secured to a layer of coil pockets. The layer of coil pockets comprises first and second coil pockets. Each of the first and second coil pockets comprise a pocket and a coil spring disposed in the pocket. The first layer of cushion members comprises an attachment member and first and second cushion members engaged with said attachment member. The attachment member is engaged with the layer of coil pockets such that the first and second cushion members act directly upon the first and second coil pockets, respectively. The first cushion member is free standing from the second cushion member thereby causing a pumping action to occur upon depression of the first cushion member and circulation of air.

BRIEF DESCRIPTION OF THE DRAWINGS

The following description of the present invention will be better understood with reference to the accompanying drawings in which.

DESCRIPTION OF THE INVENTION

Figure 1:
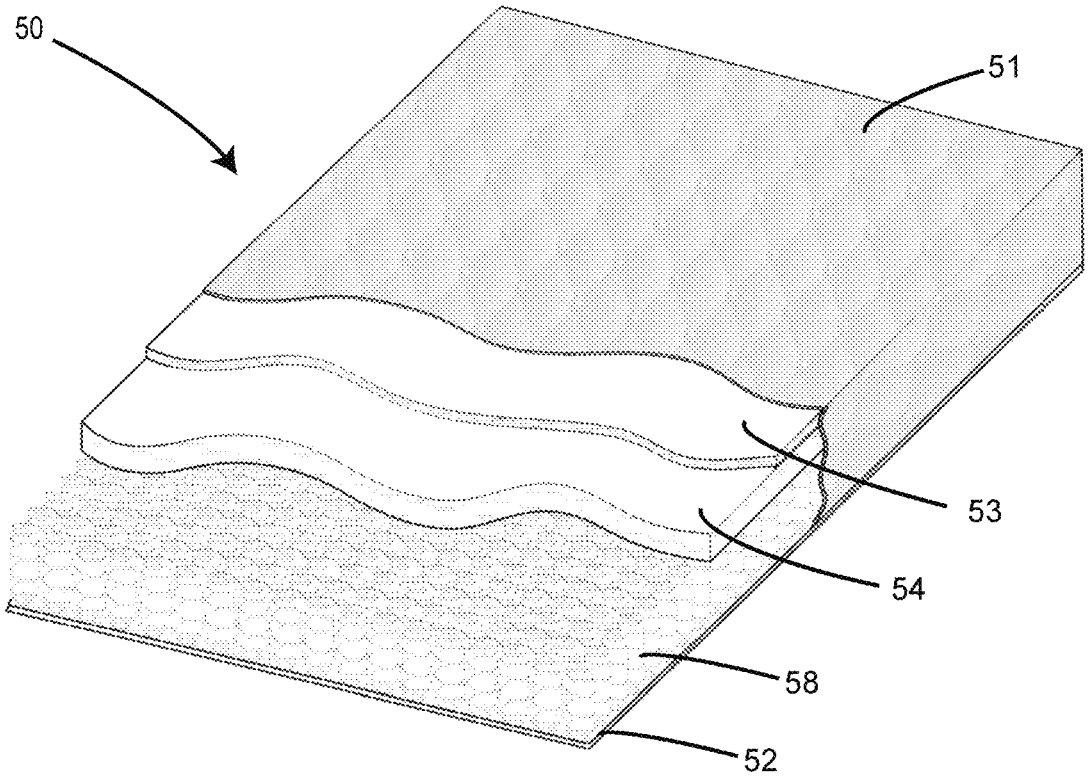
(prior art) Fig 1
FIG. 1 is a perspective view of a prior art pocket coil spring having a pocket and a coil spring disposed in the pocket.
Figure 2:
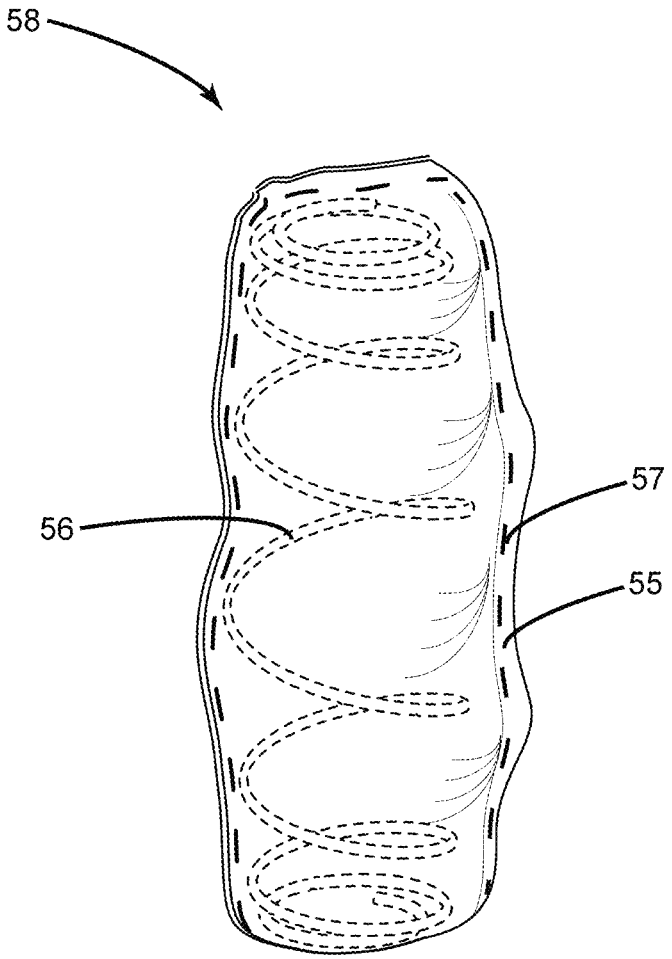
(prior art) Fig 2
FIG. 2 is a perspective view of a prior art mattress having a plurality of pocket coil springs and a plurality cushioning sheets or layers.
Figure 3:
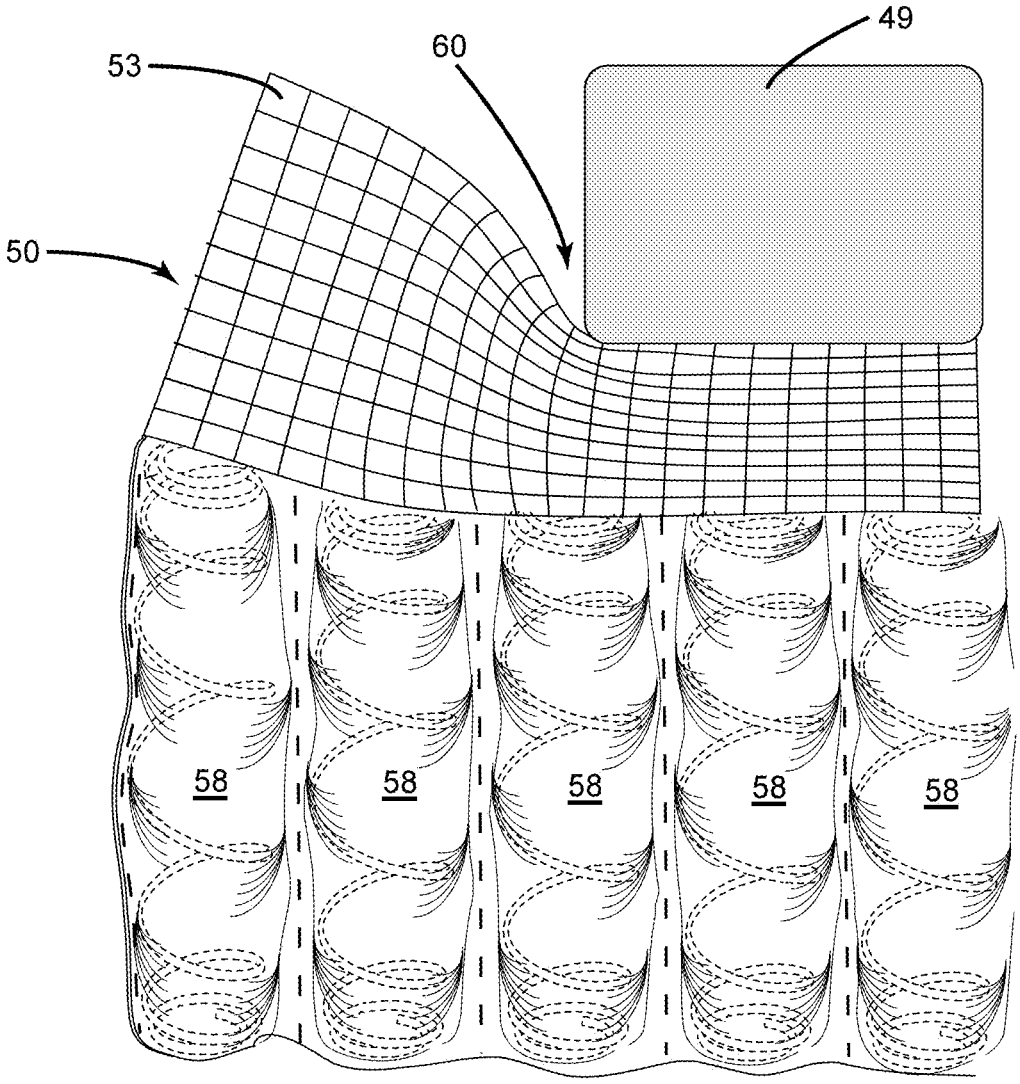
(prior art) Fig 3
FIG. 3 is an illustration of a conventional mattress with the formation of an indentation well.
Figure 4:
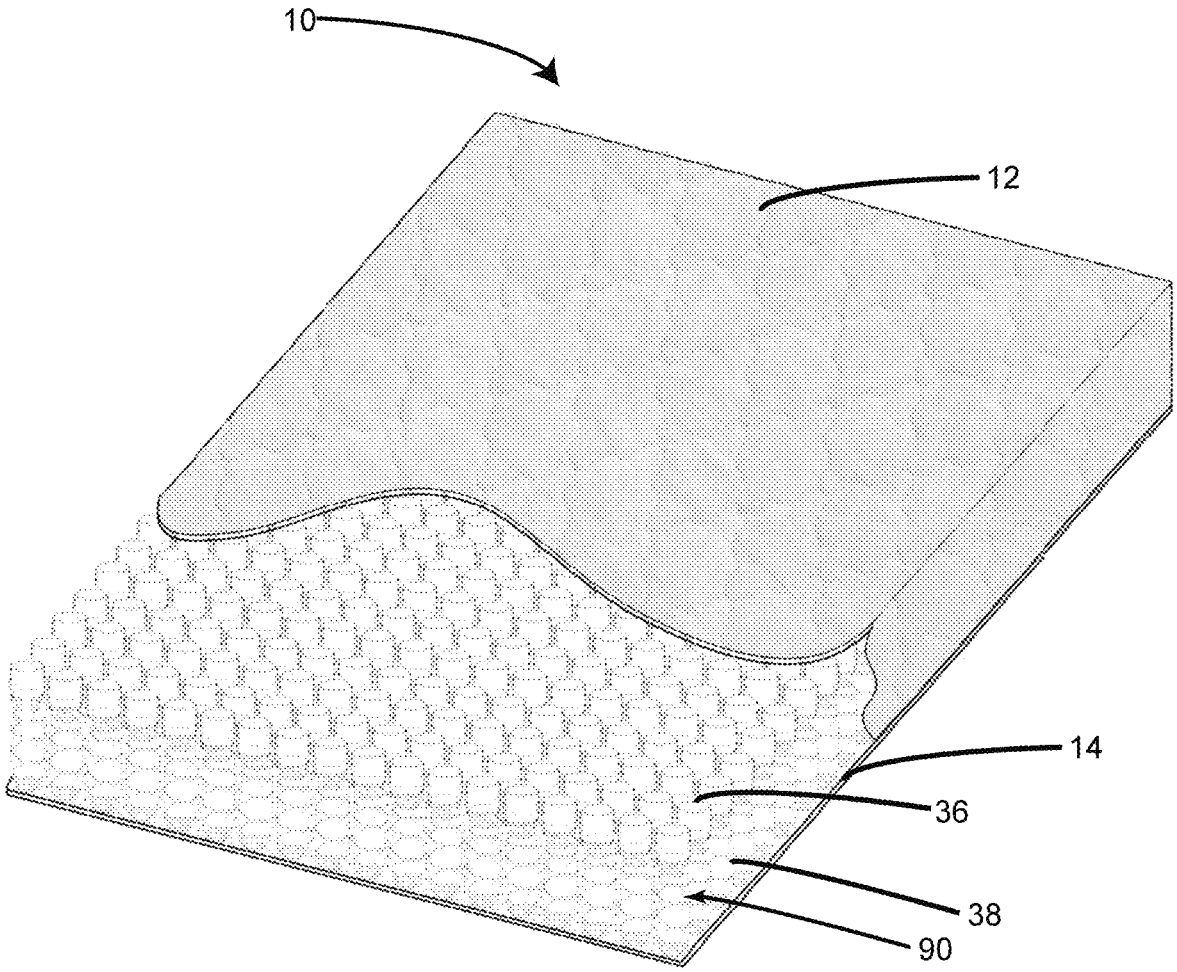
FIG. 4 is a perspective view of a one-sided mattress according to a first embodiment of the invention, in an unloaded state, showing a plurality of pocket springs each comprising a coil pocket and a cushion pocket engaged with and acting upon the coil pocket.

Referring to FIG. 4, where a mattress 10 according to a first embodiment of the present invention generally comprises a plurality of pocket springs 90 arranged in rows and columns on a base 14. Each of pocket springs 90 comprise a cushion pocket 36 disposed above and juxtaposed to a coil pocket 38. As will be described more fully herein, cushion pocket 36 is engaged with and acts directly upon coil pocket 38. Pocket springs 90 are covered on their top and sides by a mattress ticking cover 12. In this embodiment, there are no other layers of cushioning material between mattress ticking 12 and cushion pocket 36 other than the fiber filler material that can be a part of a quilted mattress ticking cover 12. In the embodiment shown, mattress 10 is a single sided or no flip mattress. However, as will be shown in additional embodiments, mattress 10 may be a two sided or reversible mattress that does not require base 14. Mattress 10 may be of size such as single, queen or king size. For a single size, mattress 10 would have about 294 pocket springs 90.

Figure 5:
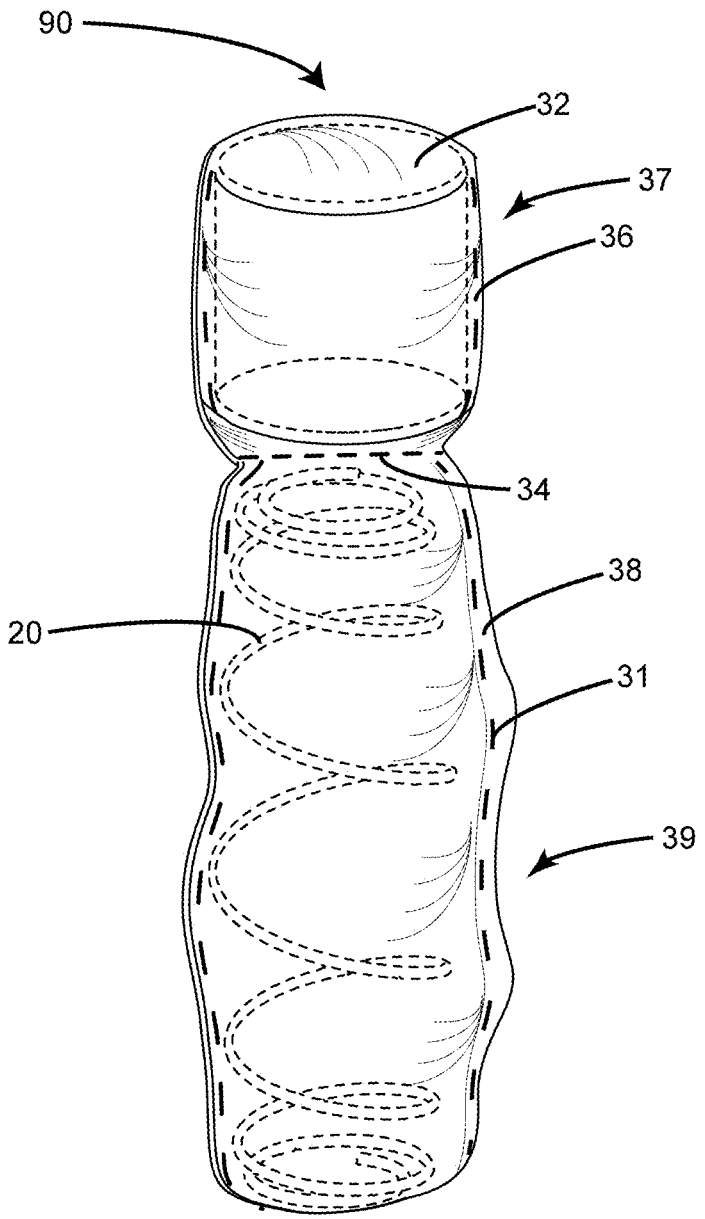
FIG. 5 is a perspective view of a pocket spring according to the first embodiment of the present invention, in an unloaded state, showing a cushion pocket engaged with and acting upon a coil pocket having a single-rate spring coil.

Referring to FIG. 5, where pocket spring 90 is shown with cushion pocket 36 disposed above and juxtaposed to coil pocket 38. This particular embodiment of pocket spring 90 is utilized in a single sided, no flip, mattress. Cushion pocket 36 produces a force when depressed by the weight of a person. Cushion pocket 36 is engaged with and directly acting upon coil pocket 38 such that substantially all of the force from cushion pocket 36 is transmitted to coil pocket 38. In this embodiment, coil pocket 38 comprises a pocket 39 and a spring 20 disposed within pocket 39. In the embodiment shown, spring 20 is a single rate barrel spring. Spring 20 may be any other type of conventional or futurely developed coil spring. By way of example only, spring 20 may be a multi-rate coil spring available under the brand name SOFT TOUCH® from Leggett & Plat Components Europe Limited, P.O. Box 681, Barnsley, S72 7WB, United Kingdom. (www.lpeurope.com/softtouch.asp). Pocket 39 may be sealed on its sides by an ultrasonic thermal bond 31. However, spring 20 could also be sealed within pocket 39 by, but not limited to, a sewn seal or an adhesive pocket seal. In this embodiment, pocket 39 is a nonwoven polyester fabric. However, many other fabrics can be used in this invention, including but not limited to, woven fabrics such as cotton, polyester, polypropylene, nylon, and fabric blends, along with nonwoven fabrics composed of polyester, polypropylene, nylon, and fabric blends. Cushion pocket 36 comprises a pocket 37 and a resilient member 32 disposed in pocket 37. Pocket 37 is fashioned from the same continuous piece of fabric that is used to fashion pocket 39 of coil pocket 38. In this embodiment, resilient member 32 is a cylindrical piece of open cell foam that resides within pocket 37 of cushion pocket 36, and pocket 37 is formed with the same ultrasonic bond 31 that formed pocket 39 of coil pocket 38. The open cell foam is available from a variety of sources such as the Foam Factory, Inc., 17500 23 Mile Road, Macomb, Mich. 48044 (http://www.thefoamfactory.com/opencellfoam/supersoft.html). Although a 4 lb per cubic foot density open cell viscoelastic foam is used as resilient member 32, many other types of foam and cushioning materials could be individually, or in some combination, contained within cushion pocket 36. They can include, but are not limited to, different density and thickness viscoelastic foam, latex foam, poly foam, poly fiber, down fiber, wool fiber, or some combination of the aforementioned. Furthermore, in this embodiment, a separation between pocket 39 of coil pocket 38 and pocket 37 of cushion pocket 36 is made with an ultrasonic thermal separation bond 34. However, it is possible to create this separation between cushion pocket 36 and coil pocket 38 with, but not limited to, a sewn separation or an adhesive line separation. In this particular embodiment, coil pocket 38 is seven inches in length topped by cushion pocket 36 that is three inches in length. The width of coil pocket 38 is approximately 2.75 inches, while the width of cushion pocket 36 is approximately 2.5 inches. However, many other length and width combinations of cushion pocket 36, and coil pocket 38, are acceptable and in no way limit the scope of this invention.

Figure 6:
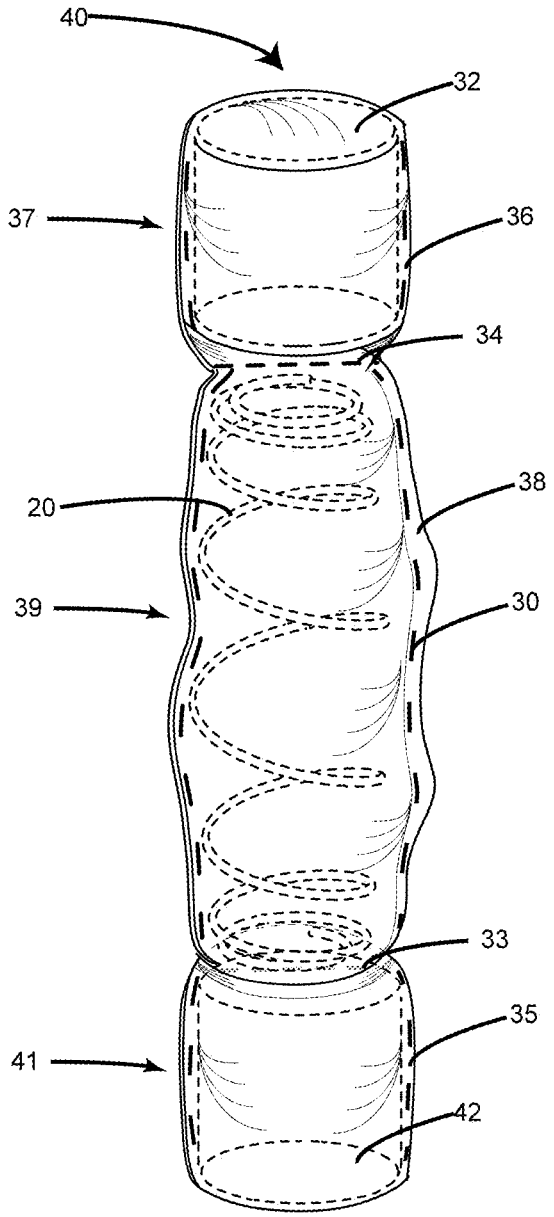
FIG. 6 is a perspective view of a pocket spring according to another embodiment of the present invention, in an unloaded state, showing a first cushion pocket engaged with and acting upon an upper portion of a coil pocket and a second cushion pocket engaged with and acting upon a lower portion of the coil spring.

Referring to FIG. 6, where in another embodiment, pocket spring 90 comprises a cushion pocket 36 on one side of and juxtaposed to coil pocket 38 and a cushion pocket 35 on the other side of and juxtaposed to coil pocket 38. Cushion pocket 35 comprises a pocket 41 and a resilient member 42 disposed in pocket 41. This particular embodiment can be utilized in, but not limited to, a two sided or reversible mattress. In this and other embodiments, resilient member 32 contained in cushion pocket 36 may be the same or different from resilient member 42 contained in cushion pocket 35. This would effectively allow the end user to flip the mattress and have a totally different cushioning response from one side of the mattress to the other. By the same token, the actual geometry of the cushion pockets can be different, with cushion pocket 36 potentially having a different diameter and, or length than that of cushion pocket 35. This would also create a different mattress cushioning profile, depending on which side of the mattress is in direct contact with the sleeper. Further to this embodiment, both coil pocket 38, cushion pocket 36, and cushion pocket 35 are formed from a single piece of fabric and made with an ultrasonic thermal separation bond 34 in the case of cushion pocket 36, and a similar ultrasonic thermal separation bond 33 (not clearly visible in the drawing) in the case of cushion pocket 35. However, it is also envisioned that either one, or both cushion pockets could be formed from a separate piece of material and bonded to coil pocket 38 by any one of a number of known bonding means. Furthermore, the separation bonds between the cushion pockets 36 and 35, and the coil pocket 38, can be but are not limited to, a sewn separation or an adhesive line separation. This embodiment is not limited to a single cushion pocket on each side of the coil pocket. Additionally, more than one cushion pocket can be stacked on top of one another or side-by-side above a coil pocket to create different cushioning profiles for each side of a flippable mattress.

Figure 7:
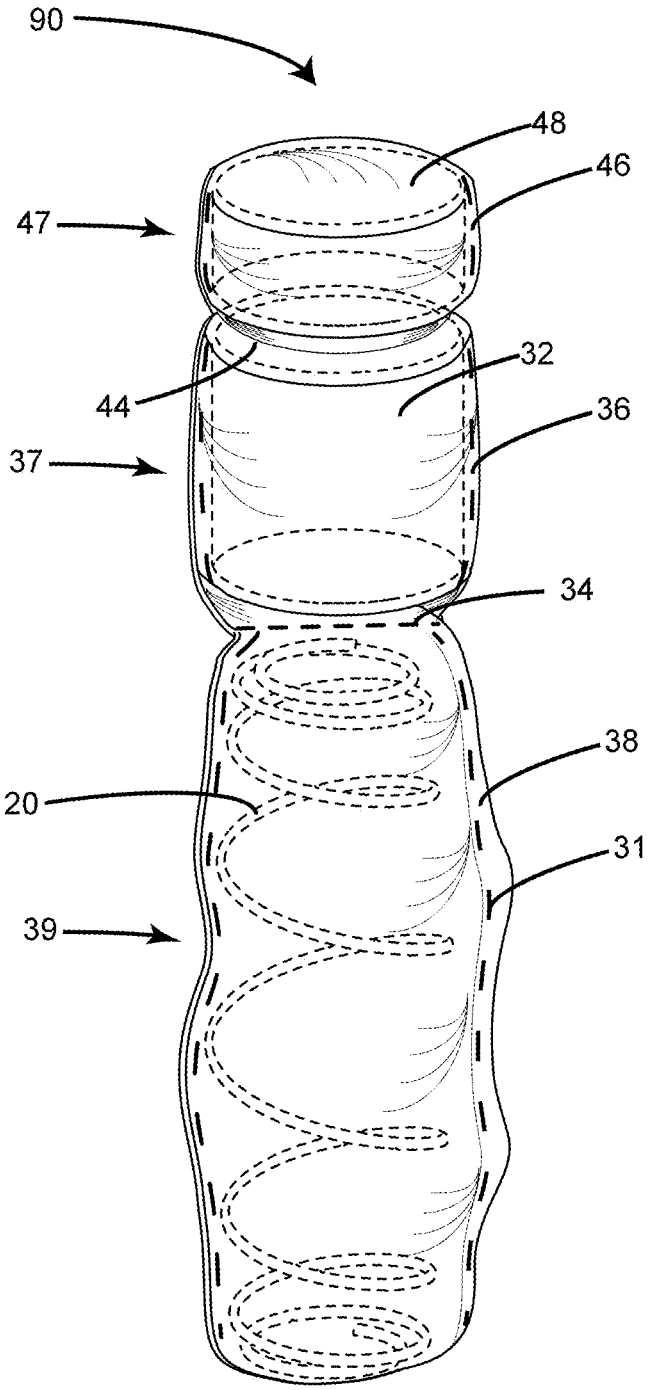
FIG. 7 is a perspective view of a pocket spring according to another embodiment of the present invention, in an unloaded state, showing a first cushion pocket engaged with and acting upon a coil pocket and a second cushion pocket engaged with and acting upon the first cushion pocket.

Referring to FIG. 7, where in another embodiment, pocket spring 90 comprises a cushion pocket 36 on one side of coil pocket 38 and a cushion pocket 46 on top of cushion pocket 36. Cushion pocket 46 comprises a pocket 47 and a resilient member 48 disposed in pocket 47. This particular embodiment is utilized in a single sided, no flip, mattress. As seen in this embodiment, more than one cushion pocket can be stacked on top of one another to create different cushioning profiles. Although this particular embodiment shows two cushion pockets 46 and 36 stacked upon coil pocket 38, this is not a limitation and it is envisioned that some other multiple number of cushion pockets could be further stacked upon one another. It can also be seen that cushion pocket 46 has a shorter length than cushion pocket 36. As is visible in this embodiment, the actual geometry of the cushion pockets can be different, with cushion pocket 36 potentially having a different diameter and, or length than that of cushion pocket 46. Further to this embodiment, both coil pocket 38, cushion pocket 36, and cushion pocket 46 are formed from a single piece of fabric and made with an ultrasonic thermal separation bond 34 in the case of cushion pocket 36, and a similar ultrasonic thermal separation bond 44 (not clearly visible in the drawing) in the case of cushion pocket 46, which is separated from cushion pocket 36. However, it is also envisioned that either one, or both cushion pockets could be formed from a separate piece of material and bonded to coil pocket 38, and to the other cushion pocket by any one of a number of known bonding means. Furthermore, the separation bonds between cushion pockets 36 and 46, and coil pocket 38, can be, but are not limited to, a sewn separation, thermal bond separation, or an adhesive line separation. It should be further noted that many length and width combinations of cushion pocket 36, cushion pocket 46, and coil pocket 38, are acceptable and in no way limit the scope of this invention.

Figure 8:
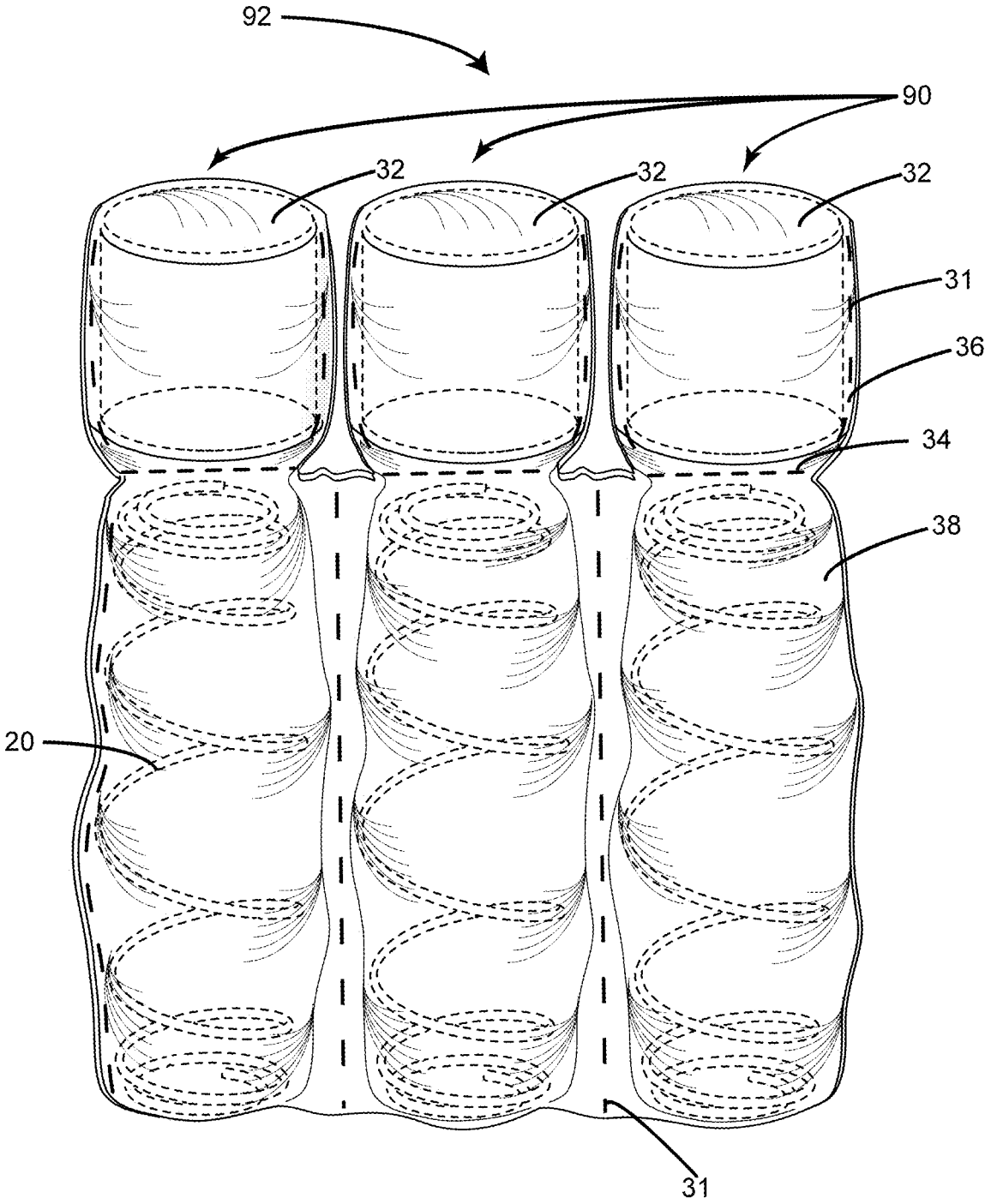
FIG. 8 is a perspective view of a pocket spring unit according to the present invention, in an unloaded state, showing a plurality of pocket springs each comprising a coil pocket and a cushion pocket engaged with and acting upon the coil pocket. Each of the coil pockets are connected with an adjoining coil pocket while each of the cushion pockets are free standing.

Referring to FIG. 8, where a partial continuous string or unit 92 is shown comprising a plurality of pocket springs 90 fabricated from a continuous length of fabric. The individual coil pockets 38, are separated from the next or preceding coil pocket by an ultrasonic thermal weld 31. Cushion pockets 36 are also formed from the same continuous piece of fabric as coil pockets 38. It should be noted that in this embodiment, after the cushion pockets 36 are formed by ultrasonic thermal welding 31, and the pocket delineation weld 34, they are then separated from the adjoining cushion pocket by cutting the fabric between their respective thermal welds. It is also possible to form the cushion pockets 36, from a separate continuous piece of fabric and secure this cushion pocket strip to the pocket coil strip by any of known means which include but are not limited adhesive bonding, thermal welding, or sewing. In other embodiments, the cushion pockets may remain connected to one another with the fabric between each cushion being flexible enough to allow independent movement of each cushion pocket. It is additionally possible to form each cushion pocket 36 from its own piece of fabric and secure it to a coil pocket 38 by one of the aforementioned means. In this embodiment, cushion pockets 36 are not connected to each other thereby allowing each cushion pocket to act directly upon its corresponding coil pocket and to allow air circulation within the mattress. Resilient member 32 cushion pocket 36 of first pocket spring 90 comprises a resiliency R1. Resilient member 32 of cushion pocket 36 of second pocket spring 90 comprises a resiliency R2. In this embodiment, resiliency R1 is equal to resiliency R2. In other embodiments, resiliency R1 may be greater or less than resiliency R2. Different values for resiliency R1 and resiliency R2 provide the ability to selectively design different comfortable levels.

Figure 9:
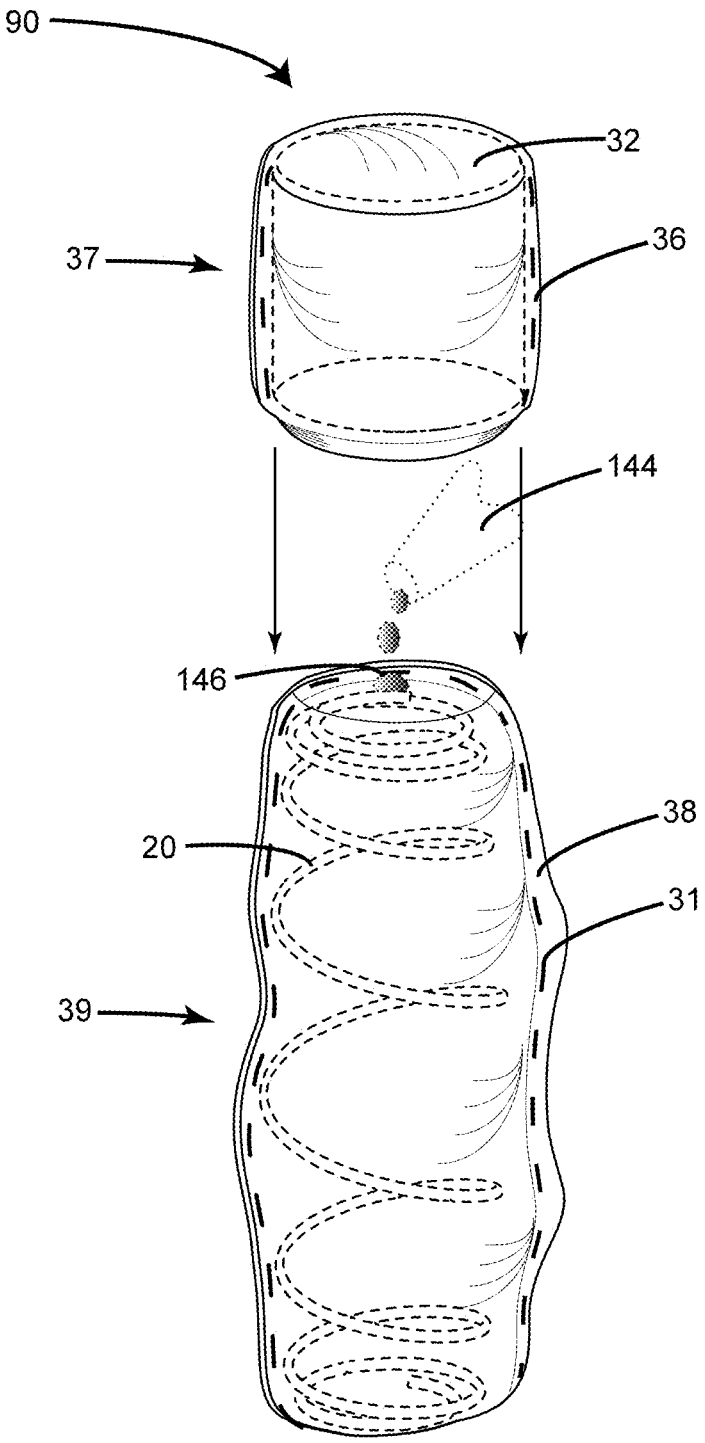
FIG. 9 is an exploded view of another embodiment of a pocket spring showing a coil pocket and a cushion pocket in the process of being attached to the coil pocket by adhesive.
Figure 10:
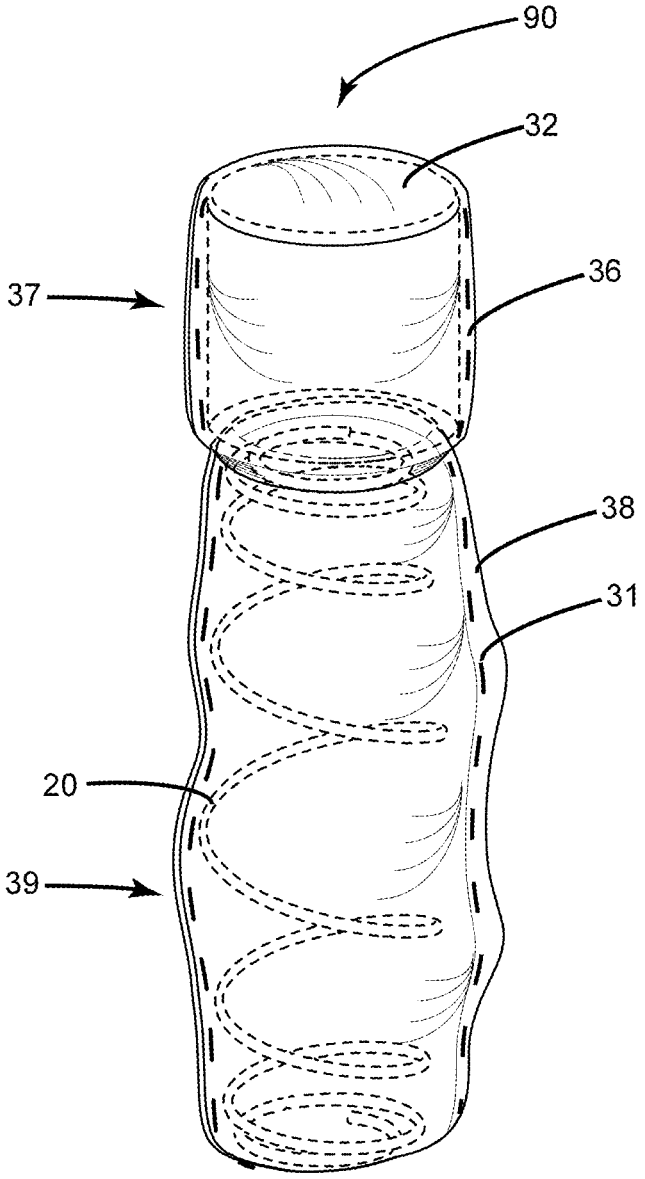
FIG. 10 is an perspective view of the spring pocket of FIG. 9 showing the cushion pocket attached to the coil pocket by adhesive.

Referring to FIGS. 9-10, where in another embodiment, pocket spring 90 is formed by hot melt adhesive bonding a cushion pocket 36 to a coil pocket 38. The complete pocket spring 90 is shown in FIG. 9. An adhesive applicator 144 is shown dispensing a hot melt adhesive 146 to the top of a previously formed coil pocket 38. A previously formed cushion pocket 36 is then lowered onto coil pocket 38 to form a completed pocket spring 90.

Figure 11:
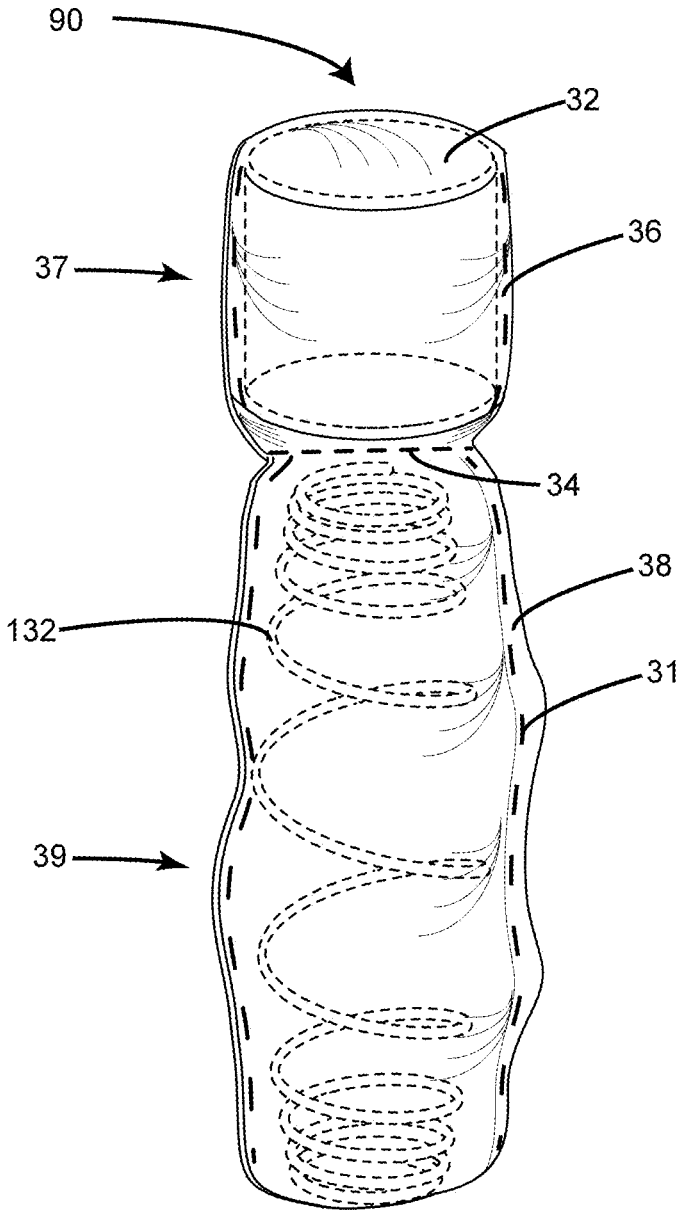
FIG. 11 is a perspective view of a pocket spring according to a first embodiment of the present invention, in an unloaded state, showing a cushion pocket engaged with and acting upon a coil pocket having a multi-rate spring coil.

Referring to FIG. 11, where in another embodiment, pocket spring 90 employs a multi-rate coil spring 132 as the spring element in coil pocket 38. Multi-rate coil spring 132 could additionally be used in any of the aforementioned embodiments that utilize more than one cushioning pockets located on one, or both sides of the coil pocket as previously described.

Figure 12:
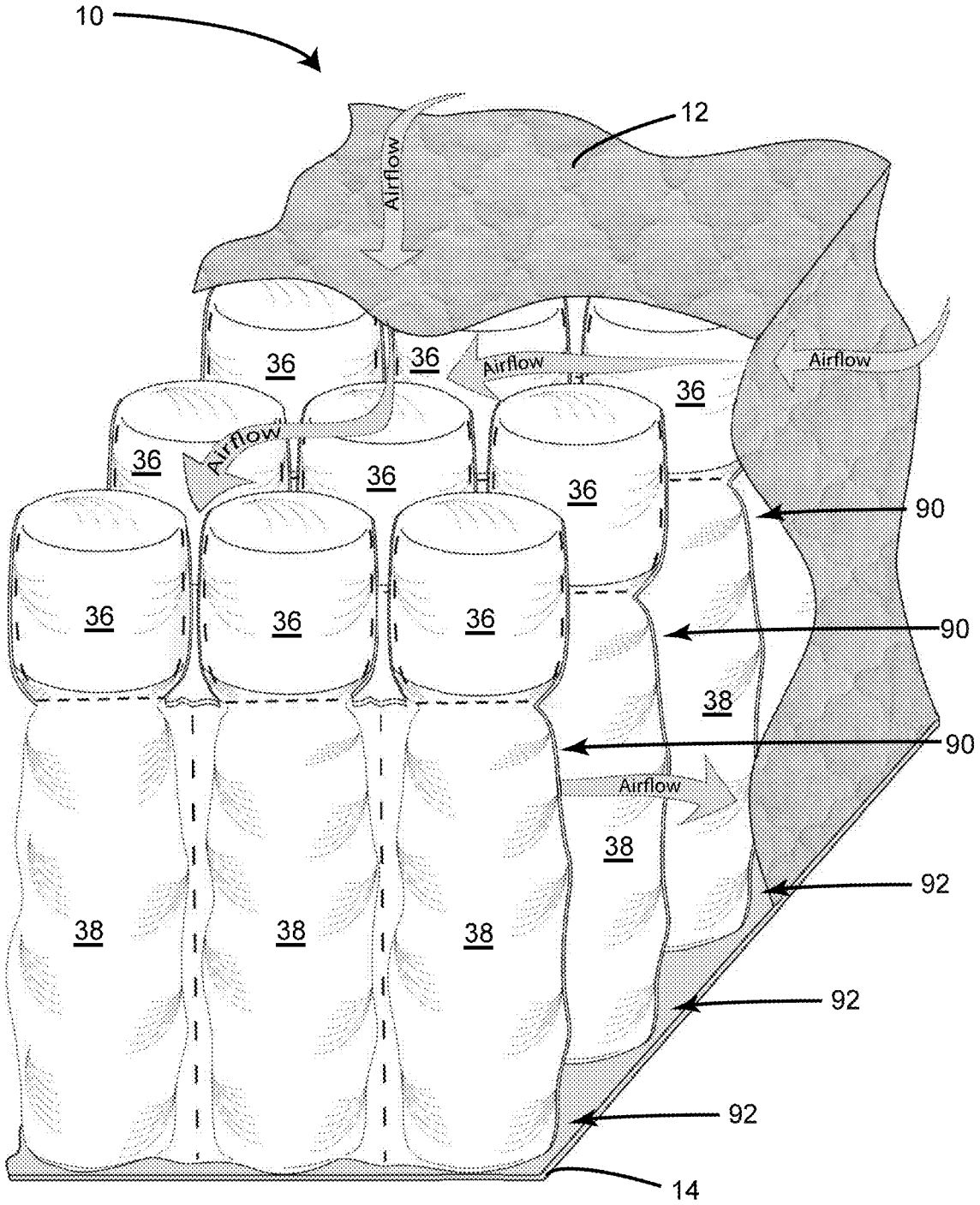
FIG. 12 is a perspective view of a mattress according to another embodiment of the invention showing, in an unloaded state, a plurality of pocket springs each comprising a coil pocket and a cushion pocket engaged with and acting upon the coil pocket. Each of the coil pockets are connected with an adjoining coil pocket while each of the cushion pockets are free standing allowing air circulation around the cushion pockets.

Referring to FIG. 12, where in another embodiment, mattress 10 comprises a plurality of pocket units 92 (previously described) arranged in rows and/or columns. As shown, pocket units 92 provides improved airflow around cushion pocket 36 of each pocket spring 90 and adjacent coil pockets 36. As can be seen in this drawing, air permeates quilted cover 12 and is able to freely circulate between adjacent cushion pockets 36 and between adjacent coil pockets 38. This is due to the fact that there are no cushioning sheets that act to block and restrict airflow into and out of the mattress core. It is also possible to have cushion pockets 36 joined to each other with excess material that still allows them to individually act on their respective coil pocket and still allow air circulation into and out of the mattress core.

The present invention provides significant benefits over conventional mattresses. First, the use of pocket springs 90 significantly reduce the formation of indentations thereby providing a new mattress with increased comfort and useful life than conventional mattresses. Second, the use of pocket springs 90 provide better air circulation than conventional mattresses thereby resulting in the sleeper sleeping cooler. Third, the use of pocket springs 90 allow the softness or hardness of the cushion pockets above individual coil pockets to be selectively controlled thereby resulting in greater mattress customization choices for consumers desiring more complex cushioning profiles. This is achievable by varying the contents, dimensions, or number of cushion pockets within a string of pocket springs. Prior to this invention, it was possible to only vary the coil spring parameters on a coil by coil basis, but not the characteristics of the sheet foam cushioning material on a coil by coil basis. Fourth, the use of pocket springs 90 allow a single sided or a two sides mattress to be easily fabricated because the cushioning material is built into pocket springs 90 and does not require additional steps to insert and secure sheet cushioning material during the mattress fabrication. Fifth, the use of the pocket springs 90 minimizes the transmission of sleeper compressive forces in the plane that is orthogonal to that of the pocket springs helping to better isolate sleeper movements. Sixth, the use of the pocket springs 90 eliminates sheet cushioning layers that are subject to shear forces from sleeper compressive loads and their resultant premature failure, resulting in a longer life mattress. Seventh, the use of the pocket springs 90 eliminates sheet cushioning layers and replaces it with individually encased foam cushion pockets. Because the cushioned pockets are individually encased in a fabric, they are inherently impervious to trapping dust, dust mites, and other microorganisms, the health hazards associated with sheet cushioning materials on conventional mattresses are substantially reduced. Eighth, the use of the pocket springs 90 eliminates sheet cushioning layers and consequently reduces the quantity of cushioning material from between 20% to 25% relative to an existing pocket coil mattress that utilizes sheet cushioning material, thereby reducing corresponding cost and weight associated with the additional sheet cushioning material. All sheet cushioning material that lies between the pocket coils of a conventional mattress are eliminated by use of the pocket springs 90. Still further, pocket springs 90 allow the fabrication of a mattress without sheet cushioning layers that have been linked to the development of decubitus ulcers in patients in nursing homes and hospitals.

Figure 13:
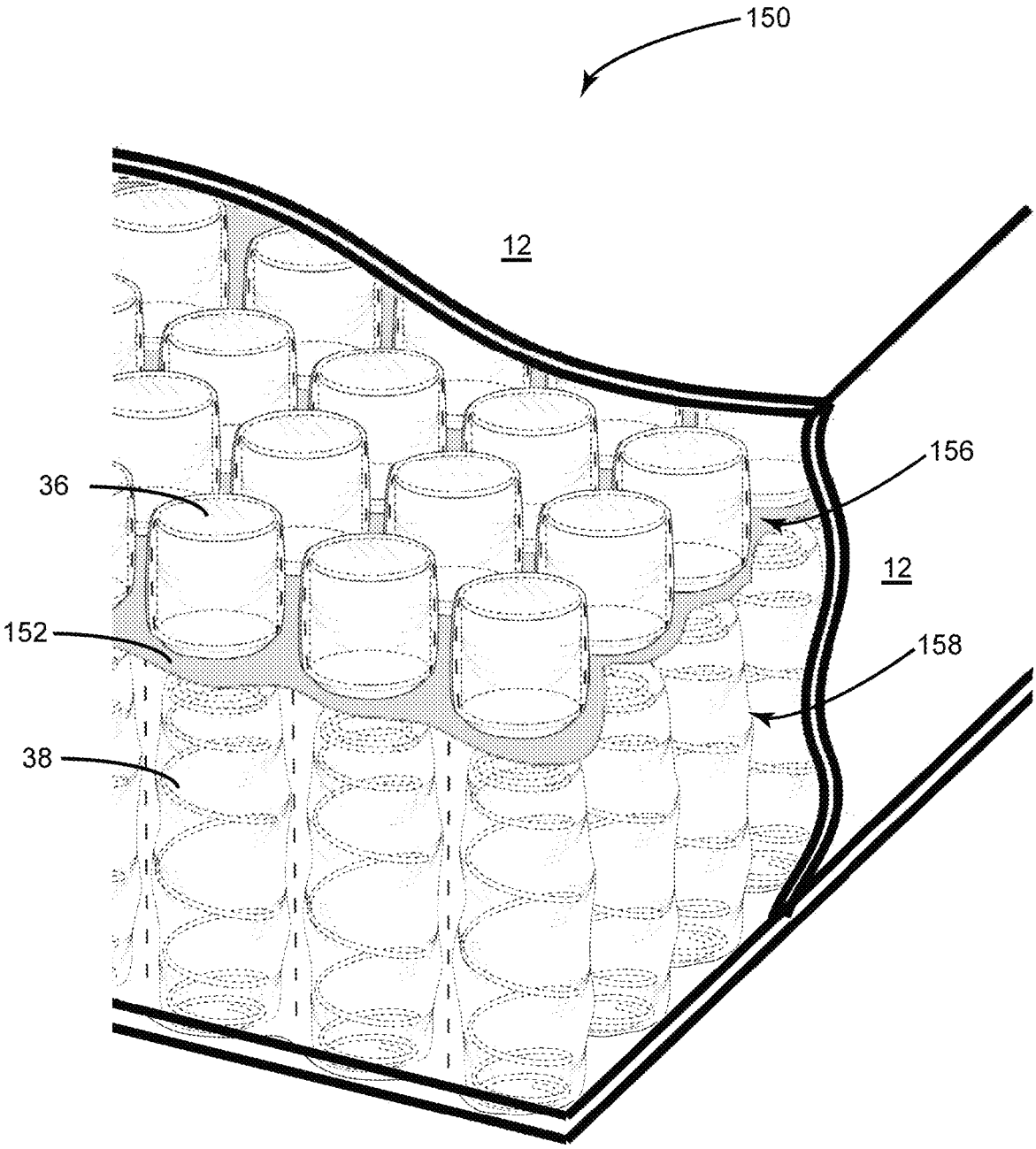
FIG. 13 is a perspective view a mattress according to another embodiment of the invention showing, in an unloaded state, a layer of coil pockets and a layer of cushion pockets. Each of the cushion pockets are engaged with and acting upon corresponding coil pockets. In this embodiment the cushion pockets are bonded to a fabric sheet to form the layer of cushion pockets.

Referring to FIG. 13, where in another embodiment of the invention, a mattress 150 comprises a layer of cushion pockets 156 composed of individual cushion pockets 36 that is distinctly separate from a layer of coil pockets 158 composed of coil pockets 38. In this embodiment, cushion pockets 36 are bonded to an attachment member 152 that in the embodiment shown is a fabric sheet. Attachment member 152 may be made from other materials such as a substantially thin layer of foam. Further, the fabric sheet ideally made from a material having quasi-isotropic properties in a single plane. The method of bonding cushion pockets 36 to attachment member 152 may be, but is not limited to, thermal bonding or adhesive bonding. The spacing and location of cushion pockets 36 is such that each cushion pocket is located directly above a coil pocket 38 that it is directly acting upon. In this embodiment, attachment member 152 is used to locate and secure cushion pockets 36 above coil pocket 158. However, other means of locating and securing the layer of cushion pockets 156 above the layer of coil pockets 158 may be employed. For example, it would be possible to locate attachment member 152 above cushion pockets 36, or alternatively between the cushion pockets. It is further possible that attachment member 152 can be composed of, but is not limited to, a porous material that is air permeable, or perforated, therefore not restricting airflow between the layer of coil pockets 158 and the layer of cushion pockets 156.

Many issues of using sheet foam in a mattress, from the indentation well effect to the trampoline effect, have been documented in this application. However, one of the benefits of utilizing sheet foam in a mattress is that it imparts lateral stability to the mattress core. In the case of a pocket coil spring unit, the sheet foam layer above the pocket coil spring unit restrains the spring core and helps it resist the lateral movements of a sleeper. The same element that makes sleeping less comfortable also keeps the mattress core from shifting under lateral sleeper loads and movements. A major advantage of using an attachment layer between a layer of pocket coils and a layer of cushion pockets is that it gives the spring core the lateral stability it loses when the sheet foam is removed. This is due to the fact that the attachment layer has quasi-isotropic properties that exhibit in-plane shear strength consistent with the fabric fibers being dispersed in the fabric plane, providing an in-plane strength. This in-plane strength helps stabilize the pocket coil unit when subjected to lateral loads.

Another benefit of the cushion pockets being attached to a separate attachment layer is that it creates an independent pocket cushion layer. This layer can be independently fabricated and stored, separate from the pocket coil layer. This gives a manufacturer much greater flexibility during the manufacturing process of matching different cushion layers, and their associated characteristics, with different pocket coil spring layers and their characteristics. The possible number of custom combinations now becomes an exponential expansion of the number of base pocket coil spring units combined with base cushion pocket layers. For example, three different pocket coil spring elements combined with three different cushion elements gives the manufacturer nine possible custom combinations. Expand the number of pocket coil spring units to five, with five different cushion pocket element layers and you now have twenty-five possible custom units. Add a second cushioning layer, and the number of possible custom units goes up to one hundred and twenty-five units. This affords a manufacturer huge custom manufacturing flexibility while only requiring a limited number of base component inventory. A further benefit of using a separate attachment layer is that it can be located above an entire pocket coil core unit with as few as two attachment points to as many as an attachment point for every pocket coil. Additionally, the type of attachment points can vary depending on the goal of the mattress manufacturer. A clip type of attachment could be utilized to make the cushion pocket layer removable, interchangeable, and washable. It is now conceivable for a mattress retailer to change the comfort layer, for example from soft to firm, subject to a customer's requirements. By simply stocking the different pocket cushion layer in their store, a retail establishment can now reconfigure a mattress by simply un-clipping one pocket cushion layer and clipping in another pocket cushion layer that has different cushioning characteristics. This could allow the retail establishment to demonstrate multiple beds in the space of a single bed, thereby reducing floor space and overhead. By the same token, a retail establishment could reduce inventory by stocking just the base units while customizing the final bed to the customer's specifications. Additionally, multiple pocket cushion attachment layers can be positioned above one another, with each layer clipping onto the previous layer, to create a different cushioning profile. For example, a cushioning layer of individual gel cushion pockets, could be positioned above, and clipped onto, a layer of foam cushion pockets to create an entirely different look and feel to the mattress. Couple this with different height, removable mattress covers, and the level of retail store customization is unlimited. At the same time, the customer experience can be greatly enhanced as they create a purely custom bed, to their own liking, inside a retail establishment, by mixing and matching different mattress components.

A disadvantage of manufacturing pocket coil springs with integral cushion pockets is the requirement that the cushion pockets be separated from one another after fabrication, as will be described in connection with FIGS. 15 and 16. This requirement requires that the cushion pocket be smaller than the pocket coil pocket since there is a need for extra material between the cushion pockets to allow them to be both sealed and separated from one another. This is a significant shortcoming since a smaller cushion pocket reduces the support area for the sleeper. In bonding the cushion pocket to an attachment layer, the cushion pockets diameter can be equal to the pocket coil diameter, and in certain cases can even be larger in diameter than the pocket coil pocket diameter. This allows us to increase the pocket cushion cross sectional area and provide increased support for the sleeper.

In an additional embodiment, rather than attach all of the cushion pockets to a single attachment layer, it is envisioned that individual attachment layer strips be utilized in which a string of pocket coils is attached to the attachment layer strip. The attachment strip would be attached to the coil pocket strips in a manner in which the direction of the cushion pocket attachment strip is at right angles to the direction of the pocket coil strips. In this way, we are providing lateral stability support to the pocket coil core. It is also possible to apply a single strip around the outer one or two rows of pocket coils to effectively create a framing mechanism that further increases the lateral support of the pocket coil core unit.

Figure 14:
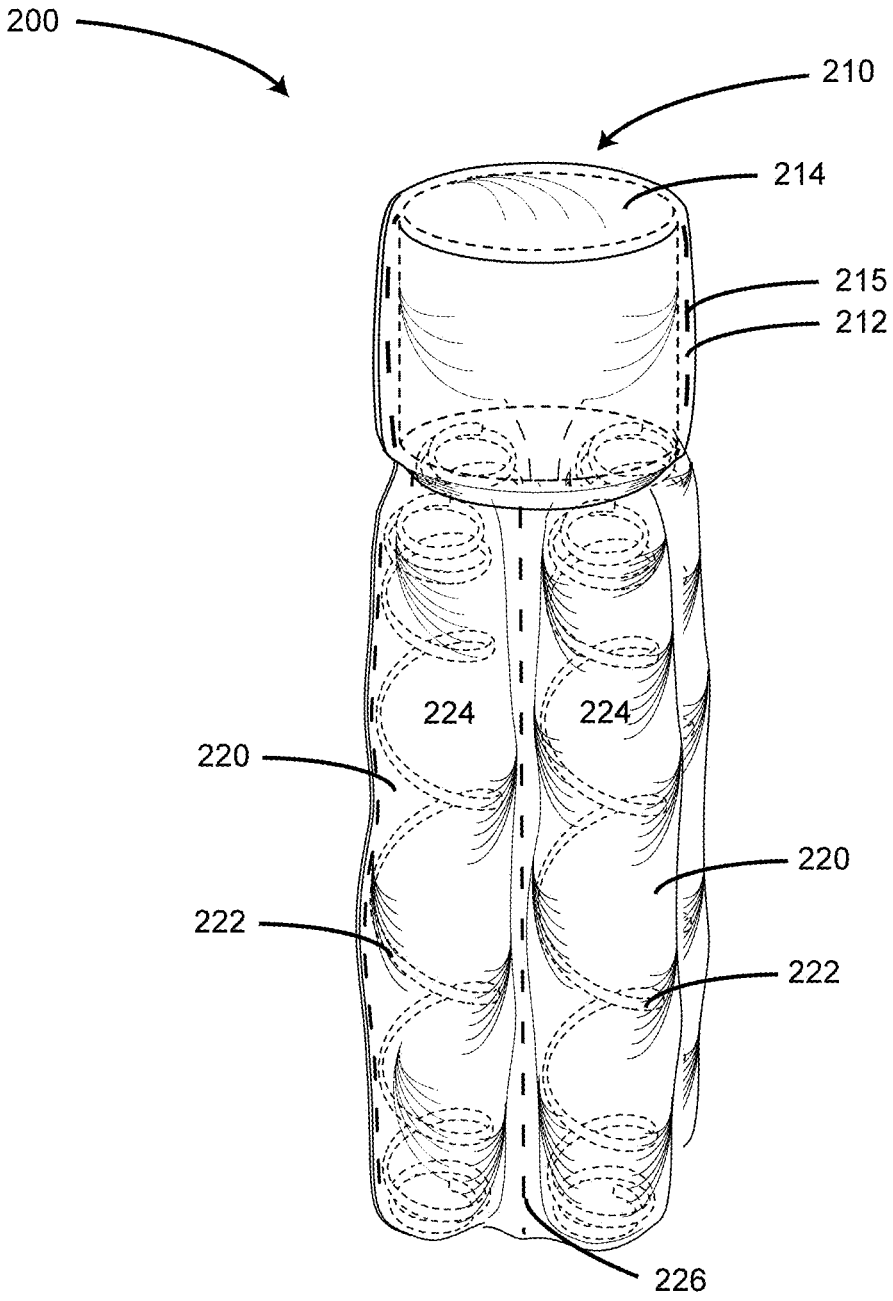
FIG. 14 is a perspective view of another embodiment of a pocket spring unit according to the present invention, in an unloaded state, showing a cushion pocket engaged with and acting directly upon a plurality of micro coil pockets.

Referring to FIG. 14, where in another embodiment, a pocket spring unit 200 according to the present invention generally comprises a cushion pocket 210 engaged with and acting directly upon a plurality of micro coil pockets 220. In the embodiment shown, cushion pocket is disposed above and juxtaposed to micro coil pockets 220. Each of micro coil pockets 220 comprise a pocket 224 and micro coil spring 222. Cushion pocket 210 comprises a pocket 212 and a resilient member 214 disposed in pocket 212. Pocket 212 is sealed by a thermal weld 215. Cushion pocket 210 is engaged with and acting directly upon micro coil pockets 220 such that substantially all of the force from cushion pocket 210 is transmitted to micro coil pockets 220. The pockets 224 of micro coil pockets 220 may be connected together by thermal weld 226. As in other embodiments, pocket 224 of micro coil pockets 220 is made from a non-woven fabric. Micro coil spring 222 may be any conventional micro coil such as a single rate micro coil spring. As in other embodiments, pocket 212 of cushion pocket 210 is may be made from a non-woven fabric and connected to micro coil pockets 220 by an adhesive. As in other embodiments, resilient member 214 may be a foam cushion having any desired resiliency. By changing the spring characteristics of micro spring 222 disposed in pocket 220 we create multi-rate pocket spring 200.

Figure 15:
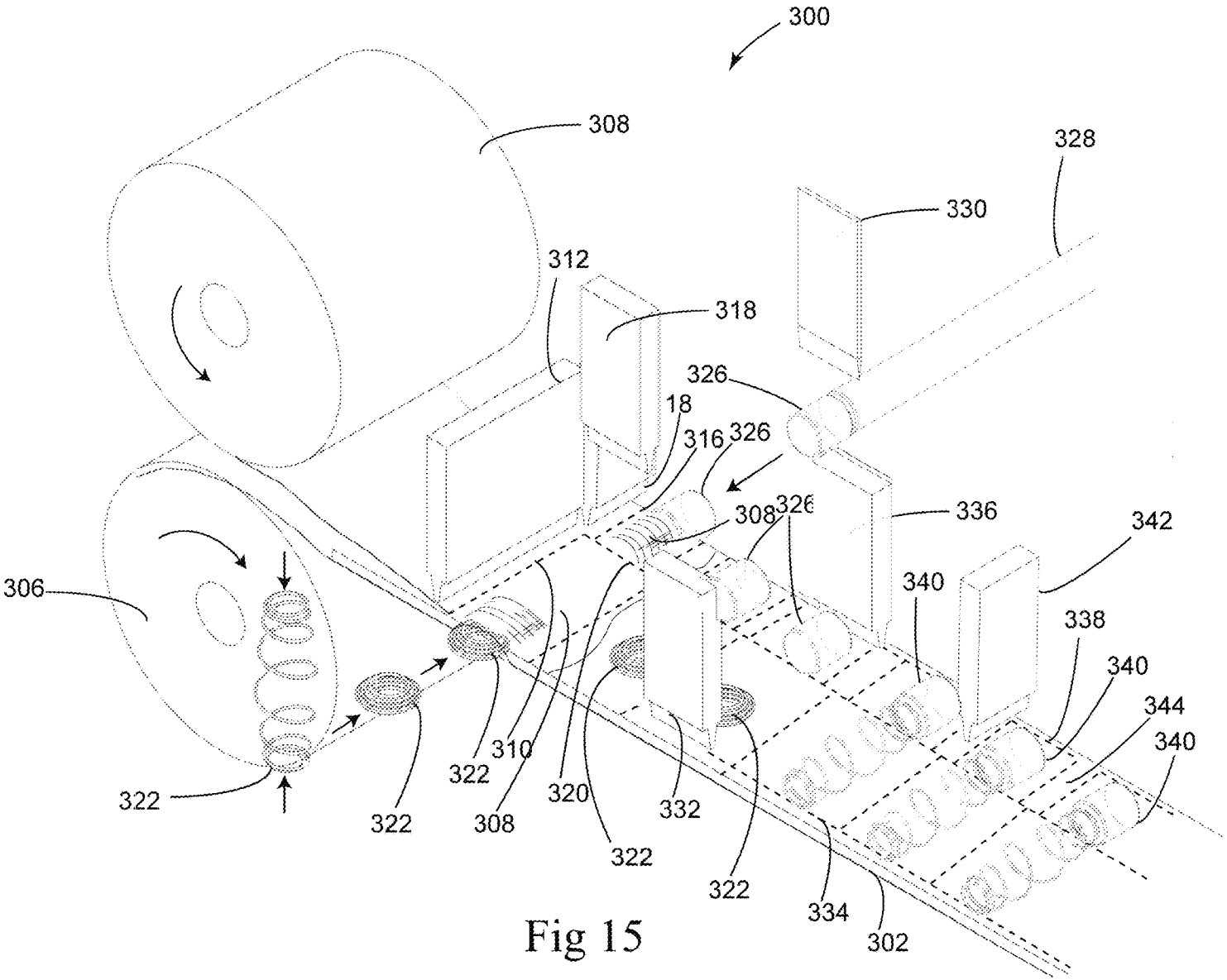
FIG. 15 is a perspective view of a machine according to another embodiment of the invention for fabricating a row or strip of pocket springs each comprising a coil pocket and a cushion pocket.

Referring to FIG. 15, where a machine 300 according to another embodiment of the present invention is shown for fabricating a row or strip of pocket springs 340 identical to pocket springs 90 described heretofore. Machine 300 generally comprises a base conveyor 302 adapted to support and move multiple layers of fabric to various forming and cutting stations. Machine 300 further comprises a lower fabric roll 304 comprising a bottom fabric 305 and an upper fabric roll 306 comprising a top fabric 307. Lower fabric roll 304, along with upper fabric roll 306, feed both bottom fabric 305 and top fabric 307, respectively, onto base conveyor 302 at the same time. Many fabrics can be used in this invention, including but not limited to, woven fabrics such as cotton, polyester, polypropylene, nylon, and fabric blends, along with non-woven fabrics composed of polyester, polypropylene, nylon, and fabric blends. Forming the sides of coil pocket 308 of is a pocket coil delineation line 310, formed by an ultrasonic bonding horn 312. Forming the sides of cushion pocket 314 is a cushion pocket delineation line 316 formed by an ultrasonic bonding horn 319. In this embodiment, all delineation lines are done via ultrasonic welding and ultrasonic welding horns. However, it is envisioned that other types of bonding apparatuses and bonding horns, such as thermal bonding with thermal bonding horns and thermally bondable fabrics could also be used. Cushion pocket 314 resides directly above coil pocket 308. However, there are twice as many cushion pocket delineation lines 316 then there are pocket coil delineation lines 310. This is due to the fact that there needs to be a cutting of the fabric between cushion pockets 314 to allow each cushion pocket 314 to be able to be compressed independently without affecting its neighboring cushion pocket 314. Additionally, ultrasonic bonding horn 318 forms a delineation line 320 between coil pocket 308 and its corresponding cushion pocket 314. Initially, an uncompressed spring 322, gets compressed by any one of well known compression devices and techniques, into a compressed coil spring 324. Compressed coil spring 324 is inserted between the upper and lower pieces of fabric into the previously formed coil pocket 308. It should be noted that compressed coil spring 324 is loaded into each coil pocket 308 in an orientation that is tangential to the final cushion pocket 314's vertical orientation. Later in the assembly process, and after the fourth side of coil pocket 308 is sealed, compressed coil spring 324 is re-oriented into the correct plane by hitting it with any of a number of known means designed to re-orient compressed coil spring 324 to uncompressed coil spring 322. This re-orientation is possible since compressed coil spring 324 has enough potential energy stored in its compressed state to allow it to correctly orient itself in coil pocket 308 given a little prodding. At roughly the same time as compressed coil spring 324 is being loaded into its coil pocket 308, cushion foam cylinder 326 is inserted into cushion pocket 314. Unlike coil spring 324, foam cushion cylinder 326, which is compressed by any one of a number of known means, is inserted in the correct final orientation into the cushion pocket 314. We maintain the correct orientation of foam cushion cylinder 326 through its insertion since the potential energy stored within the compressed foam cushion cylinder 326 is not sufficient to allow the cushion cylinder to correct its orientation if it was not in the correct orientation to start with. Another unique aspect of this invention is the cutting of the individual foam cushion cylinders 326 from a longer foam cylinder 328 by a cutting knife 330. It should be noted that knife 330 can be, but is not limited to, a shearing knife, a hot knife, or an ultrasonic cutting knife or any other cutting device or method. A big advantage of using long foam cylinder 328 in the assembly is that it insures that foam cushion cylinder 326 will always be in the correct orientation relative to cushion pocket 314. For purposes of this illustration, and to better show the entire process, the top fabric layer is removed from this illustration after the formation of the initial coil pocket 308 and cushion pocket 314. As the top and bottom fabric continue to advance on conveyor 302, coil pocket 308 is sealed by an ultrasonic bonding horn 332 forming coil pocket sealing delineation line 334. At the same time, cushion pocket 314 is sealed by an ultrasonic bonding horn 336 forming cushion pocket sealing delineation line 338. After the completed pocket spring 340 is formed, an ultrasonic cutting horn 342 is used to cut the fabric portion 344 between adjacent cushion pocket delineation lines 316. This results in a completed pocket coil cushion pocket string of whatever length that is pre-programmed to be fabricated. Different pockets lengths can be cut by changing and/or adjusting the size of the ultrasonic bonding horns thereby providing the ability to cut different cushion pocket lengths on the fly to help customize individual mattresses or create a more flexible manufacturing system that allows one to make different style foam cushions for different customers.

Figure 16:
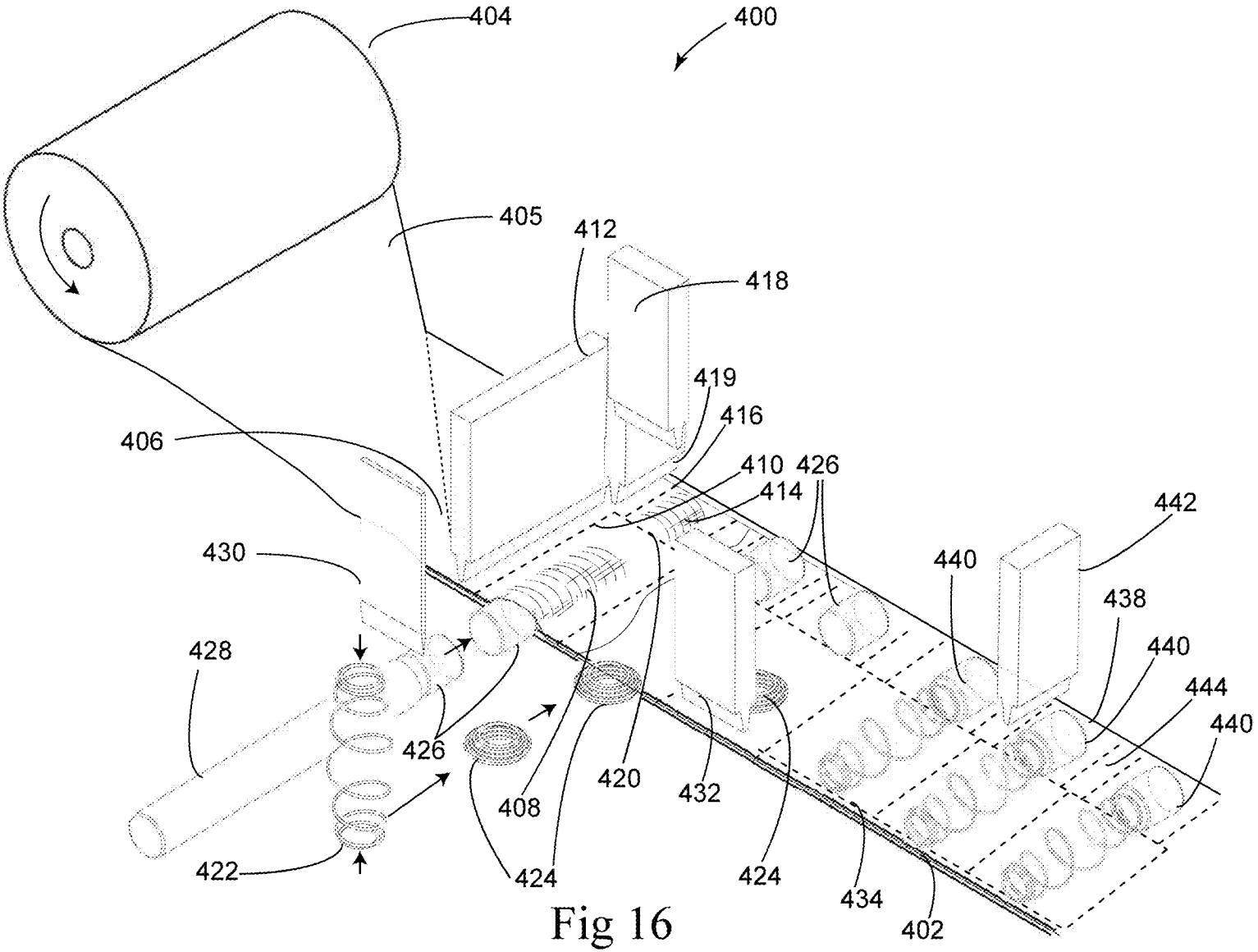
FIG. 16 is a perspective view of a machine according to another embodiment of the invention for fabricating a row or strip of pocket springs each comprising a coil pocket and a cushion pocket.

Referring to FIG. 16, where a machine 400 according to another embodiment of the present invention is shown for fabricating a row or strip of pocket springs 440. Machine 400 generally comprises a base conveyor 402 adapted to support and move a multiple layers of fabric to various forming and cutting stations. Machine 400 further comprises a fabric roll 404 comprising an unfolded fabric 405 that goes through anyone of a known fabric folded mechanism and comes out folded fabric 406. Fabric roll 404 feeds fabric 405 into a known folding mechanism and onto base conveyor 402. Many fabrics can be used in this invention, including but not limited to, woven fabrics such as cotton, polyester, polypropylene, nylon, and fabric blends, along with non-woven fabrics composed of polyester, polypropylene, nylon, and fabric blends. Forming the sides of coil pocket 408 of is a pocket coil delineation line 410, formed by an ultrasonic bonding horn 412. Forming the sides of cushion pocket 414 is a cushion pocket delineation line 416 formed by an ultrasonic bonding horn 419. In this embodiment, all delineation lines are done via ultrasonic welding and ultrasonic welding horns. However, it is envisioned that other types of bonding apparatuses and bonding horns, such as thermal bonding with thermal bonding horns and thermally bondable fabrics could also be used. Cushion pocket 414 resides directly above coil pocket 408. However, there are twice as many cushion pocket delineation lines 416 then there are pocket coil delineation lines 410. This is due to the fact that there needs to be a cutting of the fabric between cushion pockets 414 to allow each cushion pocket 414 to be able to be compressed independently without affecting its neighboring cushion pocket 414. Foam cushion cylinder 426 is compressed by any one of a number of known means, is inserted in the correct final orientation into the cushion pocket 414. We maintain the correct orientation of foam cushion cylinder 426 through its insertion since the potential energy stored within the compressed foam cushion cylinder 426 is not sufficient to allow the cushion cylinder to correct its orientation if it was not in the correct orientation to start with. Another unique aspect of this invention is the cutting of the individual foam cushion cylinders 426 from a longer foam cylinder 428 by a cutting knife 430. It should be noted that knife 430 can be, but is not limited to, a shearing knife, a hot knife, or an ultrasonic cutting knife or any other cutting device or method. A big advantage of using long foam cylinder 428 in the assembly is that it insures that foam cushion cylinder 426 will always be in the correct orientation relative to cushion pocket 414. After foam cushion cylinder 426 is placed in cushion pocket 414, ultrasonic bonding horn 418 forms a delineation line 420 between coil pocket 408 and its corresponding cushion pocket 414. The folded fabric 406 now advance to the coil spring loading station. An uncompressed spring 422, gets compressed by any one of well known compression devices and techniques, into a compressed coil spring 424. Compressed coil spring 424 is inserted between the upper and lower folds of folded fabric 406 and into the previously formed coil pocket 408. It should be noted that compressed coil spring 424 is loaded into each coil pocket 408 in an orientation that is tangential to the final cushion pocket 414's vertical orientation. Later in the assembly process, and after the fourth side of coil pocket 408 is sealed, compressed coil spring 424 is re-oriented into the correct plane by hitting it with any of a number of known means designed to re-orient compressed coil spring 424 to uncompressed coil spring 422. This re-orientation is possible since compressed coil spring 424 has enough potential energy stored in its compressed state to allow it to correctly orient itself in coil pocket 408 given a little prodding. For purposes of this illustration, and to better show the entire process, the top piece of the folded fabric 406 is removed from this illustration after the formation of the initial coil pocket 408 and cushion pocket 414. As the folded fabric 406 continues to advance on conveyor 402, coil pocket 408 is sealed by an ultrasonic bonding horn 432 forming coil pocket sealing delineation line 434. It should be noted that there is no need to seal cushion pocket 414 since the fold of fabric 406 provides a natural enclosure for cushion pocket 414. After the completed pocket spring 440 is formed, an ultrasonic cutting horn 442 is used to cut the fabric portion 444 between adjacent cushion pocket delineation lines 416. This results in a completed pocket coil cushion pocket string of whatever length that is pre-programmed to be fabricated.

In another embodiment, the method comprises the step of using a cylindrical tube of cushioning material (foam) to feed into a cushion pocket so that the cushioning material is always correctly oriented relative to the preformed pocket. The method further comprises the step of slicing an individual length of foam from the cylindrical tube of cushioning material prior to inserting into the pocket. The method further comprises the step of using a compression set of jaws to pre-compress the foam so that it easily inserts into the pocket and maintains its final orientation in the insertion process. Alternatively, using a compression set of jaws to pre-compress the end of the foam cylinder and inserting the foam cylinder into the pre-made fabric pocket, and cutting the foam after insertion to create an individual foam cylinder in the fabric pocket.

In another embodiment, the method comprises the step of folding over a continuous piece of fabric. The method further comprises the step of forming two pocket delineation lines, tangential to the movement of the fabric, that define the sides of a first cushion pocket. Inserting the foam from the open side of the fabric, into the pocket, placing the foam or coil up against the top fold in the fabric. The method further comprises the step of sealing the fourth side of the first cushion pocket. The method further comprises the step of moving the fabric and first cushion pocket a distance that is sufficient enough to create a length of inter-cushion pocket fabric that will allow a first cushion pocket to be fully compressed without causing any distortion in an uncompressed second cushion pocket. The method further comprises the step of forming two pocket delineation lines, tangential to the movement of the fabric, that define the sides of a second cushion pocket. The method further comprises the step of inserting the foam from the open side of the fabric, into the pocket, placing the foam or coil up against the top fold in the fabric. The method further comprises the step of sealing the fourth side of the second cushion pocket. Continue to form a continuous cushion pocket strip in the ascribed manner. The method further comprises the step of bonding the continuous cushion pocket strip onto a previously made pocket coil strip where each cushion pocket resides directly above or below a pocket coil spring and where the excess fabric between the cushion pockets allow each cushion pocket to be compressed without influencing it's neighboring cushion pocket.

In another embodiment, the method comprises the step of folding over a continuous piece of fabric. The method further comprises the step of forming two pocket delineation lines, tangential to the movement of the fabric, that define the sides of a first cushion pocket. Inserting the foam from the open side of the fabric, into the pocket, placing the foam or coil up against the top fold in the fabric. The method further comprises the step of sealing the fourth side of the first cushion pocket. The method further comprises the step of cutting out the individual cushion pocket. The method further comprises the step of bonding the individual cushion pocket onto a previously made pocket coil strip where each cushion pocket resides directly above or below a pocket coil spring. Continue to bond individual cushion pockets onto the pocket coil strips until a complete pocket coil cushion core is completed.

Figure 17:
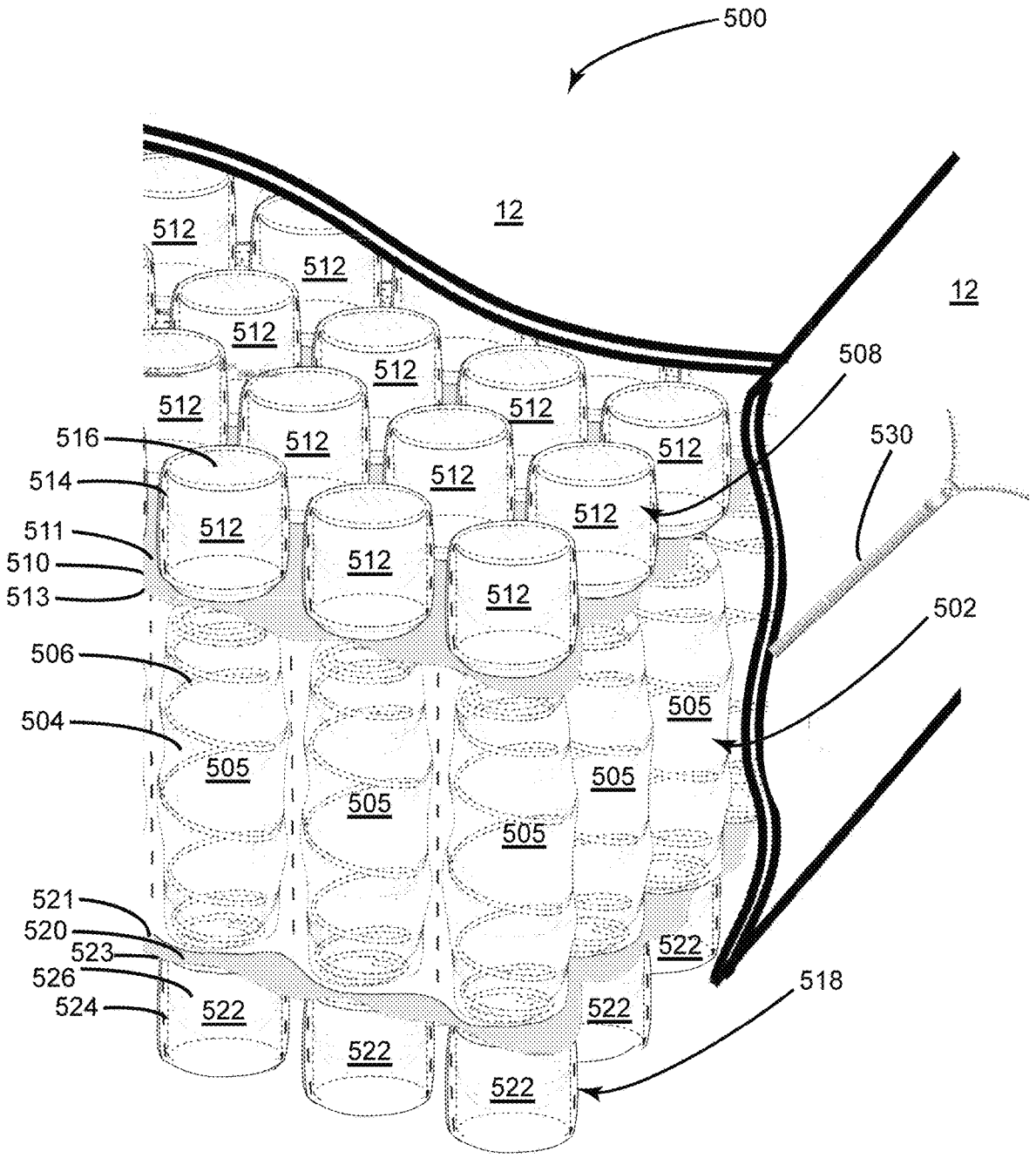
FIG. 17 is a view of a doubled sided mattress according to another embodiment of the invention showing, in an unloaded state, a first layer of cushion pockets disposed above a layer of coil pockets and a second layer of cushion pockets disposed below the layer of coil pockets.

Referring to FIG. 17, where in another embodiment of the invention, a mattress 500 comprises an upper layer of cushion pockets 508 fastened to the top of a layer of coil pockets 502 as described in the embodiment of FIG. 13. Upper layer of cushion pockets 508 is separate and distinct from layer of coil pockets 502. In this embodiment, mattress 500 further comprises a lower layer of cushion pockets 518 fastened to the bottom of the layer of coil pockets 502. Lower layer of cushion pockets 518 is separate and distinct from layer of coil pockets 502. In this manner, mattress 500 provides a doubled sided mattress that can be flipped. Further, upper layer of cushion pockets 508 can have a resiliency R1 and/or a softness that is different from the elasticity and/or softness of lower layer of cushion pockets 518. Layer of coil pockets 502 comprises a plurality of coil pockets 505. Each of coil pockets 505 comprise a pocket 504 and a coil spring 506 disposed in pocket 505. Upper layer of cushion pockets 508 comprises an attachment member 510 having upper and lower and upper surfaces 511 and 513, respectively, and a plurality of cushion pockets 512 secured to upper surface 511. Each of cushion pockets 512 comprise a pocket 514 and a cushion member 516 disposed in each pocket 514. Lower layer of cushion pockets 518 comprises an attachment member 520 having upper and lower surfaces 521 and 523, respectively, and a plurality of cushion pockets 522 secured to lower surface 523. Each of cushion pockets 522 comprises a pocket 524 and a cushion member 526 disposed in each pocket 524. As in the embodiment of FIG. 13, cushion pockets 512 and 522 are bonded to attachment members 510 and 520, respectively, that in the embodiment shown is a fabric sheet. The spacing and location of cushion pockets 512 is such that each cushion pocket of upper layer of cushion pockets 508 is located directly above a coil pocket 505 that it is directly acting upon. Similarly, the spacing and location of cushion pockets 522 is such that each cushion pocket of lower layer of cushion pockets 518 is located directly below a coil pocket 505 that it is directly acting upon. As in previously described embodiments, each of pockets 504, 514, and 524 are a fabric material and each of cushion members 516 and 526 are pieces of foam. Coil spring 506 may be any type of spring such as a multi-rate coil spring.

Figure 18:
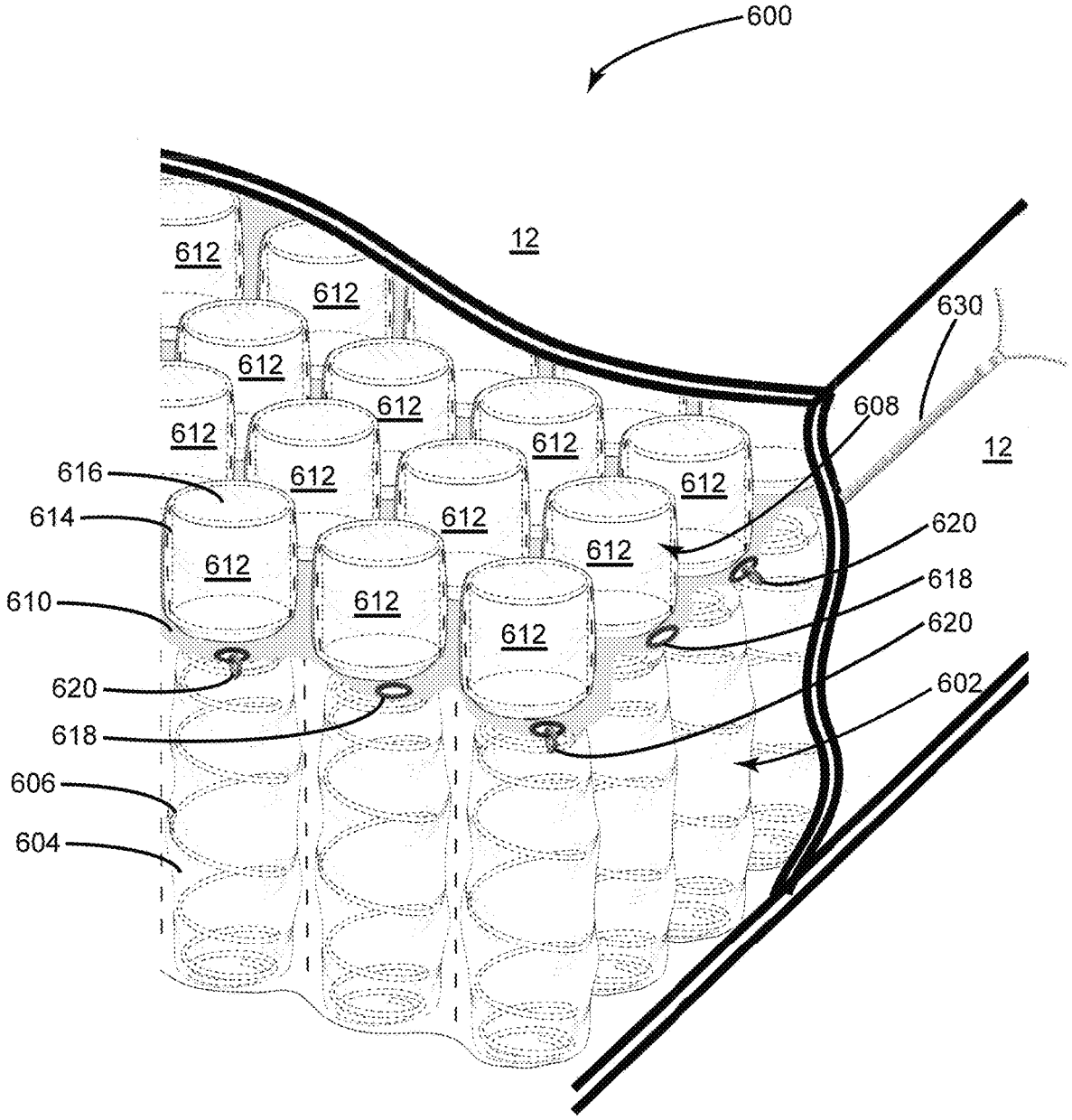
FIG. 18 is a view of a single sided mattress according to another embodiment of the invention showing, in an unloaded state, a layer of cushion pockets removably engaged with a layer of coil pockets.

Referring to FIG. 18, where in another embodiment, a mattress 600 comprises an upper layer of cushion pockets 608 attached to the top layer of coil pockets 602 by mechanical clips 620 that are inserted through a grommet 618, and through the coil spring 606. As in FIG. 13, the cushion pockets 612 are bonded to an attachment member 610, that in this embodiment is a fabric sheet made from a material having quasi-isotropic properties. Also, as in FIG. 13, the spacing and location of cushion pockets 612 is such that each cushion pocket 612 is located directly above a coil pocket 604 that it is directly acting upon. It should be noted that the upper layer of cushion pockets 608 is separate and distinct from the layer of coil pockets 602. Although one type of clip and grommet combination is shown, it should be obvious to anyone who is skilled in the art that other forms of mechanical clips, that can clamp onto the fabric attachment layer 610, and mechanically clamp onto the coil pocket 604 and encased coil spring 606 are also feasible. Alternatively, the clip or fastener can attach directly to a border wire or rod typically employed. With such mechanical clamping devices, the need to provide grommets 618 on the attachment layer 610 may be eliminated. All of the benefits that are described in the description of the embodiment of FIG. 13 are available in this embodiment. Additionally, by the use of a mechanical fastener 620, a manufacturer, a retail establishment, or end user can easily attach, or remove, a layer of cushion pockets 608, from a layer of coil pockets 602 by an attachment member 610. The ability to add or remove the upper layer of cushion pockets 608 affords a manufacturer considerably greater manufacturing flexibility when fabricating a mattress. For instance, the manufacturer can reduce his mattress component inventory and just stock a few skews of pocket coil units, along with an assortment of cushion pocket layers, and mix and match these two components during assembly to create a multitude of mattress models. For the retail establishment, the ability to change cushion pocket layers in short order allows the store to keep one demonstration unit, that has a layer of coil springs 602, inside a mattress covering 12, that can be accessed by unzipping the mattress cover 12 with zipper 630, thereby allowing the establishment to change out the cushion layer 608 to demonstrate a multitude of different comfort levels. Additionally, the retailer can customize a mattress to a customer's exact comfort preference by mixing an matching different cushion pocket layers 608 with a pocket coil layer 602. At the same time, an end user who might decide to change the mattresses comfort level at a future date, can potentially remove the cushion pocket layer 608 by releasing mechanical clips 620, and replace the cushion pocket layer 608 with one that has a different cushion member 616 resilience.

Figure 19:
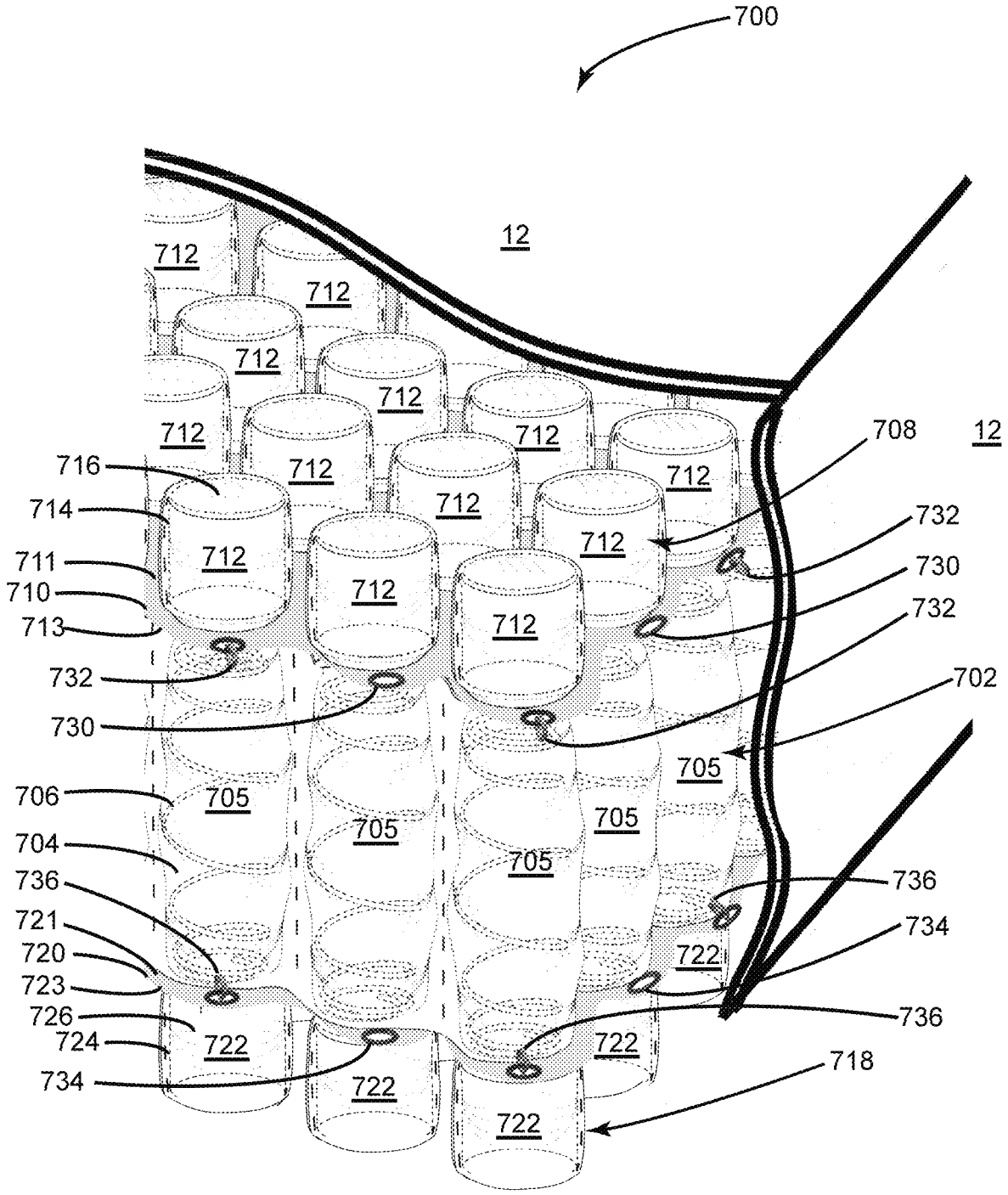
FIG. 19 is a view of a doubled sided mattress according to another embodiment of the invention showing, in an unloaded state, a first layer of cushion pockets removably engaged with the top of a layer of coil pockets and a second layer of cushion pockets removably engaged with the bottom of the layer of coil pockets.

Referring to FIG. 19, where in another embodiment of the invention, a mattress 700 comprises an upper layer of cushion pockets 708 fastened to the top of a layer of coil pockets 702 by mechanical clips 732 that are inserted through a grommet 730, and through the coil spring 706. Upper layer of cushion pockets 708 is separate and distinct from layer of coil pockets 702. In this embodiment, mattress 700 further comprises a lower layer of cushion pockets 718 fastened to the bottom of the layer of coil pockets 702 by mechanical clips 736 that are inserted through a grommet 734, and through the coil spring 706. Although one type of clip and grommet combination is shown, it should be obvious to anyone who is skilled in the art that other forms of mechanical clips are also feasible. With such mechanical clamping devices, the need to provide grommets 730 on the attachment layer 710, and grommets 734 on attachment layer 720 may be eliminated. Lower layer of cushion pockets 718 is separate and distinct from layer of coil pockets 702. In this manner, mattress 700 provides a doubled sided mattress that can be flipped. Further, upper layer of cushion pockets 708 can have an elasticity E1 and/or a softness that is different from the elasticity and/or softness of lower layer of cushion pockets 718. Layer of coil pockets 702 comprises a plurality of coil pockets 705. Each of coil pockets 705 comprise a pocket 704 and a coil spring 706 disposed in pocket 705. Upper layer of cushion pockets 708 comprises an attachment member 710 having upper and lower surfaces 711 and 713, respectively, and a plurality of cushion pockets 712 secured to upper surface 711. Each of cushion pockets 712 comprise a pocket 714 and a cushion member 716 disposed in each pocket 714. Lower layer of cushion pockets 718 comprises an attachment member 720 having upper and lower and upper surfaces 721 and 723, respectively, and a plurality of cushion pockets 722 secured to lower surface 723. Each of cushion pockets 722 comprises a pocket 724 and a cushion member 726 disposed in each pocket 724. As in the embodiment of FIG. 13, cushion pockets 712 and 722 are bonded to attachment members 710 and 720, respectively, that in the embodiment shown is a fabric sheet. The spacing and location of cushion pockets 712 is such that each cushion pocket of upper layer of cushion pockets 708 is located directly above a coil pocket 705 that it is directly acting upon. Similarly, the spacing and location of cushion pockets 722 is such that each cushion pocket of lower layer of cushion pockets 718 is located directly below a coil pocket 705 that it is directly acting upon. As in previously described embodiments, each of pockets 704, 714, and 724 are a fabric material and each of cushion members 716 and 726 are pieces of foam. Coil spring 706 may be any type of spring such as a multi-rate coil spring. As in FIG. 13, the cushion pockets 712 are bonded to an attachment member 710, that in this embodiment is a fabric sheet made from a material having quasi-isotropic properties. The cushion pockets 722 are bonded to an attachment member 720, that in this embodiment is a fabric sheet made from a material having quasi-isotropic properties. Also, as in FIG. 13, the spacing and location of cushion pockets 712 is such that each cushion pocket 712 is located directly above a coil pocket 705 that it is directly acting upon. The spacing and location of cushion pockets 722 is such that each cushion pocket 722 is located directly below a coil pocket 705 that it is directly acting upon. All of the benefits that are described in the description of the embodiment of FIG. 13 are available in this embodiment. As described in the embodiment of FIG. 18, all of the benefits of using a mechanical fastener are available in this two sided mattress embodiment.

Figure 20:
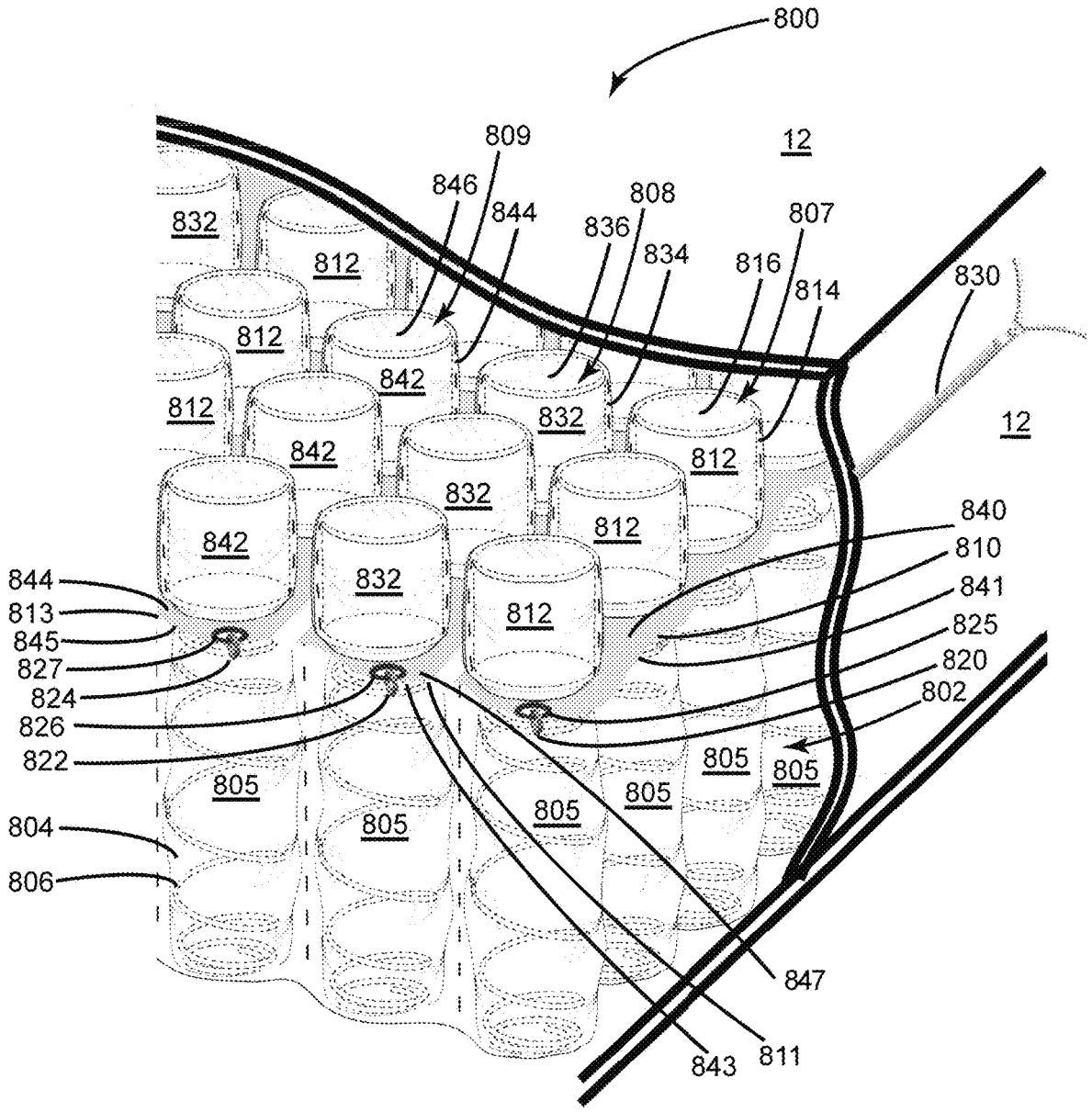
FIG. 20 is a view of a single sided mattress according to another embodiment of the invention showing, in an unloaded state, a plurality of strips of cushion pockets removably engaged with a layer of coil pockets.

Referring to FIG. 20, where in another embodiment, a mattress 800 comprises an upper layer of cushion pockets that are zoned, thereby affording different pocket cushion characteristics in different areas of the sleep surface. In this particular embodiment, the cushion layer is made up of three alternating and repeating rows of cushion pockets. For purpose of this discussion, the foam cushion elements in each zoned row differ in term of foam resiliency. Other zoning possibilities can include, but are not limited to different cushion pocket geometries, different cushioning materials, and different combinations and geometries of the cushion attachment layer. Zone number 1 contains a row of cushion pockets 807, attached to the top layer of coil pockets 802 by mechanical clips 820 that are inserted through a grommet 825, and through the coil spring 806. As in FIG. 13, the cushion pockets 812 are bonded to the top side 840 of an attachment member 810, that in this embodiment is a fabric sheet made from a material having quasi-isotropic properties. Also, as in FIG. 13, the spacing and location of cushion pockets 812 is such that each cushion pocket 812 is located directly above a coil pocket 805 that it is directly acting upon. Cushion pocket 812, in this embodiment, has a foam cushion member 816 that has a resiliency R1. It should be noted that the upper layer of cushion pockets 812 is separate and distinct from the layer of coil pockets 802. Although one type of clip and grommet combination is shown, it should be obvious to anyone who is skilled in the art that other forms of mechanical clips, that can clamp onto the fabric attachment layer 810, and mechanically clamp onto the coil pocket 804 and encased coil spring 806 are also feasible. With such mechanical clamping devices, the need to provide grommets 825 on the attachment layer 810 may be eliminated. Zone number 2 contains a row of cushion pockets 808, attached to the top layer of coil pockets 802 by mechanical clips 822 that are inserted through a grommet 826, and through the coil spring 806. As in FIG. 13, the cushion pockets 832 are bonded to the top side 847 of an attachment member 811, that in this embodiment is a fabric sheet made from a material having quasi-isotropic properties. Also, as in FIG. 13, the spacing and location of cushion pockets 832 is such that each cushion pocket 832 is located directly above a coil pocket 805 that it is directly acting upon. Cushion pocket 832, in this embodiment, has a foam cushion member 836 that has a resiliency R2. It should be noted that the upper layer of cushion pockets 832 is separate and distinct from the layer of coil pockets 802. Although one type of clip and grommet combination is shown, it should be obvious to anyone who is skilled in the art that other forms of mechanical clips, that can clamp onto the fabric attachment layer 811, and mechanically clamp onto the coil pocket 804 and encased coil spring 806 are also feasible. With such mechanical clamping devices, the need to provide grommets 826 on the attachment layer 811 may be eliminated. Zone number 3 contains a row of cushion pockets 809, attached to the top layer of coil pockets 802 by mechanical clips 824 that are inserted through a grommet 827, and through the coil spring 806. As in FIG. 13, the cushion pockets 842 are bonded to the top side 844 of an attachment member 813, that in this embodiment is a fabric sheet made from a material having quasi-isotropic properties. Also, as in FIG. 13, the spacing and location of cushion pockets 842 is such that each cushion pocket 842 is located directly above a coil pocket 805 that it is directly acting upon. Cushion pocket 842, in this embodiment, has a foam cushion member 846 that has a resiliency R3. It should be noted that the upper layer of cushion pockets 842 is separate and distinct from the layer of coil pockets 802. Although one type of clip and grommet combination is shown, it should be obvious to anyone who is skilled in the art that other forms of mechanical clips, that can clamp onto the fabric attachment layer 813, and mechanically clamp onto the coil pocket 804 and encased coil spring 806 are also feasible. With such mechanical clamping devices, the need to provide grommets 827 on the attachment layer 813 may be eliminated. All of the benefits that are described in the description of the embodiment of FIG. 13 are available in this embodiment. Additionally, by the use of a mechanical fasteners 820, 822, and 824, a manufacturer can easily attach, or remove, zoned layers of cushion pockets from a layer of coil pockets 802. The ability to completely change the comfort configuration of a mattress by clanging the zoned layer of cushion pockets 807, 808, and 809, and the corresponding resiliency of a zoned area R1, R2, and R3, gives a manufacturer almost limitless comfort profiles. At the same time, the manufacturer needs only stock a handful of different layers of cushion pockets to achieve this flexibility.

Figure 21:
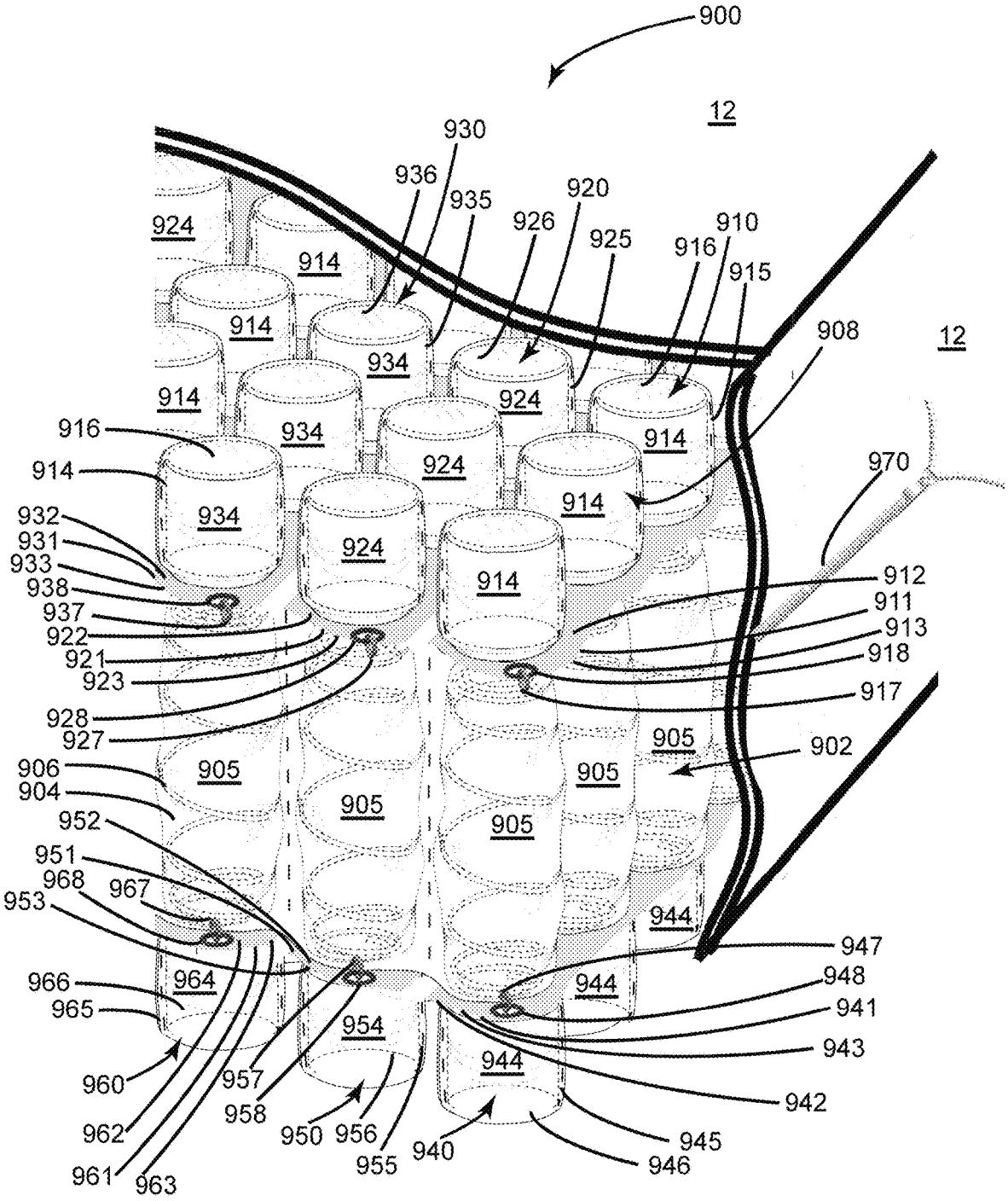
FIG. 21 is a view of double sided mattress according to another embodiment of the invention showing, in an unloaded state, a plurality of strips of cushion pockets removably engaged with the top of a layer of coil pockets and a plurality of straps of cushion pockets removably engaged with the bottom of the layer of coil pockets.

Referring to FIG. 21, where in another embodiment, a mattress 900 comprises an upper layer, and a lower layer of cushion pockets that are zoned, thereby affording different pocket cushion characteristics in different areas of the sleep surface. Further, mattress 900 provides a doubled sided mattress that can be flipped. Further, upper layer of cushion pockets can have an elasticity El and/or a softness that is different from the elasticity and/or softness of lower layer of cushion pockets. In this particular embodiment, the cushion layer on each side of the mattress is made up of three alternating and repeating rows of cushion pockets. For purpose of this discussion, the foam cushion elements in each zoned row differ in terms of foam resiliency. Other zoning possibilities can include, but are not limited to different cushion pocket geometries, different cushioning materials, and different combinations and geometries of the cushion attachment layer. Zone number 1 contains a row of cushion pockets 910, attached to the top layer of coil pockets 905 by mechanical clips 917 that are inserted through a grommet 918, and through the coil spring 906. As in FIG. 13, the cushion pockets 914 are bonded to the top side 912 of an attachment member 911, that in this embodiment is a fabric sheet made from a material having quasi-isotropic properties. Also, as in FIG. 13, the spacing and location of cushion pockets 914 is such that each cushion pocket 914 is located directly above a coil pocket 905 that it is directly acting upon. Cushion pocket 914, in this embodiment, has a foam cushion member 916 that has a resiliency R1. It should be noted that the upper layer of cushion pockets 914 is separate and distinct from the layer of coil pockets 902. Although one type of clip and grommet combination is shown, it should be obvious to anyone who is skilled in the art that other forms of mechanical clips, that can clamp onto the fabric attachment layer 911, and mechanically clamp onto the coil pocket 904 and encased coil spring 906 are also feasible. With such mechanical clamping devices, the need to provide grommets 918 on the attachment layer 911 may be eliminated. Zone number 2 contains a row of cushion pockets 920, attached to the top layer of coil pockets 902 by mechanical clips 927 that are inserted through a grommet 928, and through the coil spring 906. As in FIG. 13, the cushion pockets 924 are bonded to the top side 922 of an attachment member 921, that in this embodiment is a fabric sheet made from a material having quasi-isotropic properties. Also, as in FIG. 13, the spacing and location of cushion pockets 924 is such that each cushion pocket 924 is located directly above a coil pocket 905 that it is directly acting upon. Cushion pocket 924, in this embodiment, has a foam cushion member 926 that has a resiliency R2. It should be noted that the upper layer of cushion pockets 924 is separate and distinct from the layer of coil pockets 902. Although one type of clip and grommet combination is shown, it should be obvious to anyone who is skilled in the art that other forms of mechanical clips, that can clamp onto the fabric attachment layer 921, and mechanically clamp onto the coil pocket 904 and encased coil spring 906 are also feasible. With such mechanical clamping devices, the need to provide grommets 928 on the attachment layer 921 may be eliminated. Zone number 3 contains a row of cushion pockets 930, attached to the top layer of coil pockets 902 by mechanical clips 937 that are inserted through a grommet 938, and through the coil spring 906. As in FIG. 13, cushion pockets 934 are bonded to the top side 932 of an attachment member 931, that in this embodiment is a fabric sheet made from a material having quasi-isotropic properties. Also, as in FIG. 13, the spacing and location of cushion pockets 934 is such that each cushion pocket 934 is located directly above a coil pocket 905 that it is directly acting upon. Cushion pocket 934, in this embodiment, has a foam cushion member 936 that has a resiliency R3. It should be noted that the upper layer of cushion pockets 934 is separate and distinct from the layer of coil pockets 902. Although one type of clip and grommet combination is shown, it should be obvious to anyone who is skilled in the art that other forms of mechanical clips, that can clamp onto the fabric attachment layer 931, and mechanically clamp onto the coil pocket 904 and encased coil spring 906 are also feasible. With such mechanical clamping devices, the need to provide grommets 938 on the attachment layer 931 may be eliminated. All of the benefits that are described in the description of the embodiment of FIG. 13 are available in this embodiment. Additionally, by the use of a mechanical fasteners 917, 927, and 937, a manufacturer can easily attach, or remove, zoned layers of cushion pockets from a layer of coil pockets 902. The ability to completely change the comfort configuration of a mattress by clanging the zoned layer of cushion pockets 910, 920, and 930, and the corresponding resiliency of a zoned area R1, R2, and R3, gives a manufacturer almost limitless comfort profiles. At the same time, the manufacturer needs only stock a handful of different layers of cushion pockets to achieve this flexibility. In addition, this mattress is double sided and likewise zoned on the other mattress sides with zone 4, zone 5, and zone 6. Zone number 4 contains a row of cushion pockets 940, attached to the bottom layer of coil pockets 902 by mechanical clips 947 that are inserted through a grommet 948, and through the coil spring 906. The cushion pockets 940 are bonded to the bottom side 941 of an attachment member 943, that in this embodiment is a fabric sheet made from a material having quasi-isotropic properties. As in FIG. 13, the spacing and location of cushion pockets 940 is such that each cushion pocket 940 is located directly below a coil pocket 905 that it is directly acting upon. Cushion pocket 944, in this embodiment, has a foam cushion member 946 that has a resiliency R4. Zone number 5 contains a row of cushion pockets 950, attached to the bottom layer of coil pockets 902 by mechanical clips 957 that are inserted through a grommet 958, and through the coil spring 906. The cushion pockets 950 are bonded to the bottom side 951 of an attachment member 953, that in this embodiment is a fabric sheet made from a material having quasi-isotropic properties. As in FIG. 13, the spacing and location of cushion pockets 950 is such that each cushion pocket 950 is located directly below a coil pocket 905 that it is directly acting upon. Cushion pocket 954, in this embodiment, has a foam cushion member 956 that has a resiliency R5. Zone number 6 contains a row of cushion pockets 960, attached to the bottom layer of coil pockets 902 by mechanical clips 967 that are inserted through a grommet 968, and through the coil spring 906. The cushion pockets 960 are bonded to the bottom side 961 of an attachment member 963, that in this embodiment is a fabric sheet made from a material having quasi-isotropic properties. As in FIG. 13, the spacing and location of cushion pockets 960 is such that each cushion pocket 960 is located directly below a coil pocket 905 that it is directly acting upon. Cushion pocket 964, in this embodiment, has a foam cushion member 966 that has a resiliency R6. Given the aforementioned levels of zoning, Mattress 900 can be fabricated in a multitude of different configuration from a small number of cushion attachment layers and a pocket coil spring.

Figure 22:
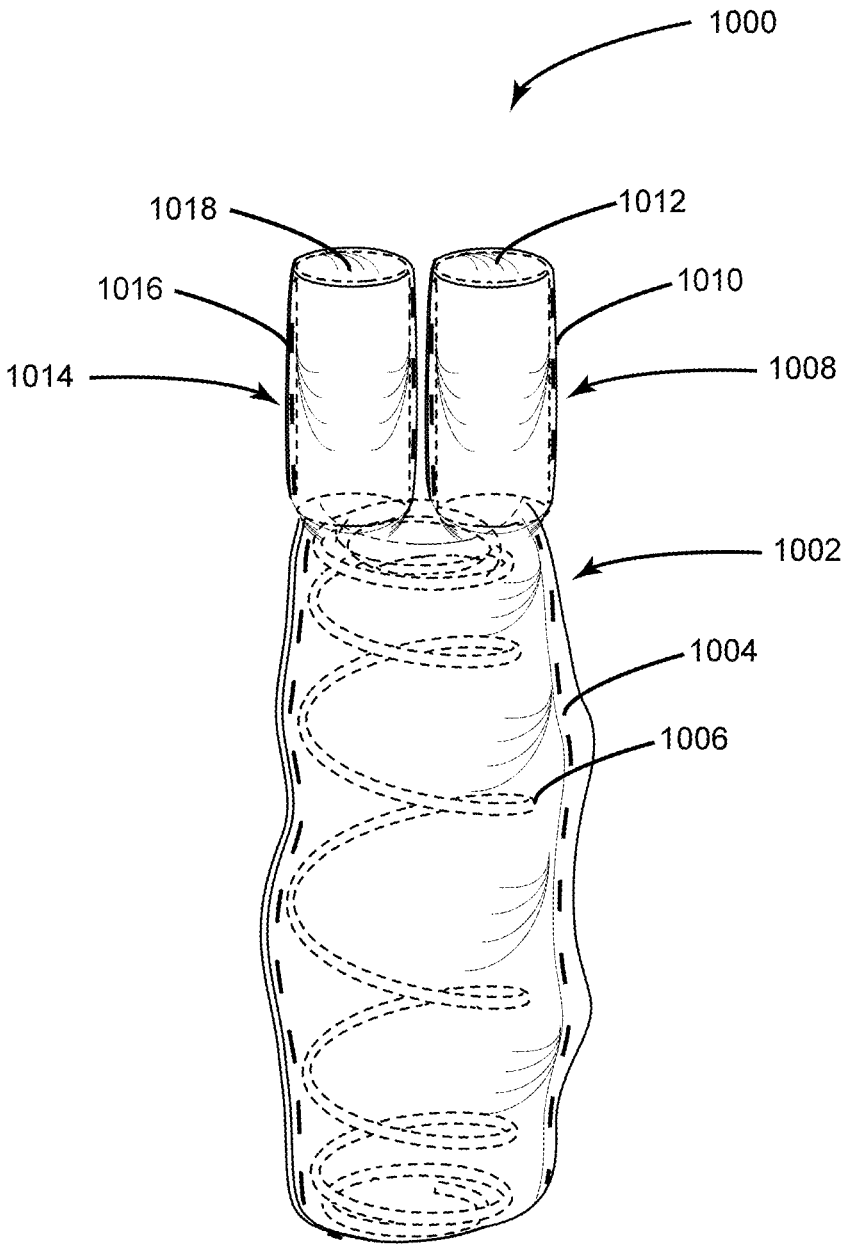
FIG. 22 is a view of a pocket spring according to another embodiment of the invention comprising first and second micro cushion pockets disposed above and engaged with a single coil pocket.

Referring to FIG. 22, where in another embodiment, a pocket spring unit 1000 according to the present invention generally comprises a first cushion pocket 1008 engaged with and acting directly upon a coil pocket 1002. Additionally, a second cushion pocket 1014 engaged with and acting directly upon a coil pocket 1002. In the embodiment shown, each cushion pocket is disposed above and juxtaposed to coil pocket 1002. The coil pocket 1002 comprises a pocket 1004 and a coil spring 1006. Cushion pocket 1008 comprises a pocket 1010 and a resilient member 1012 disposed in pocket 1010. Cushion pocket 1014 comprises a pocket 1016 and a resilient member 1018 disposed in pocket 1016. Cushion pocket 1008 is engaged with and acting directly upon coil pocket 1002 such that substantially all of the force from cushion pocket 1008 is transmitted to coil pocket 1002. Cushion pocket 1014 is engaged with and acting directly upon coil pocket 1002 such that substantially all of the force from cushion pocket 1014 is transmitted to coil pocket 1002. As in other embodiments, pocket 1004 of coil pocket 1002 is made from a non-woven fabric. Coil spring 1006 may be any conventional coil such as a single rate coil spring. As in other embodiments, pocket 1010 of cushion pocket 1008 may be made from a non-woven fabric and connected to coil pocket 1002 by an adhesive or other conventional means. As in other embodiments, pocket 1014 of cushion pocket 1016 may be made from a non-woven fabric and connected to coil pocket 1002 by an adhesive. As in other embodiments, resilient member 1012 may be a foam cushion having any desired resiliency R1. As in other embodiments, resilient member 1018 may be a foam cushion having any desired resiliency R2. Resiliency R1 may be the same as resiliency R2 or may be designed to have a different resiliency to create a multi-rate cushion assembly. It is also possible for first cushion pocket 1008 to have a different geometry than that of second cushion pocket 1014. Based on the different geometry of the two cushion pockets, R1 of cushion pocket 1008 will be different than R2 of cushion pocket 1014 thereby creating a multi-rate cushion assembly. Furthermore, this invention is not limited to the two micro cushion of this embodiment, but may include a number of micro-cushions greater than two such as three micro-cushions.

Figure 23:
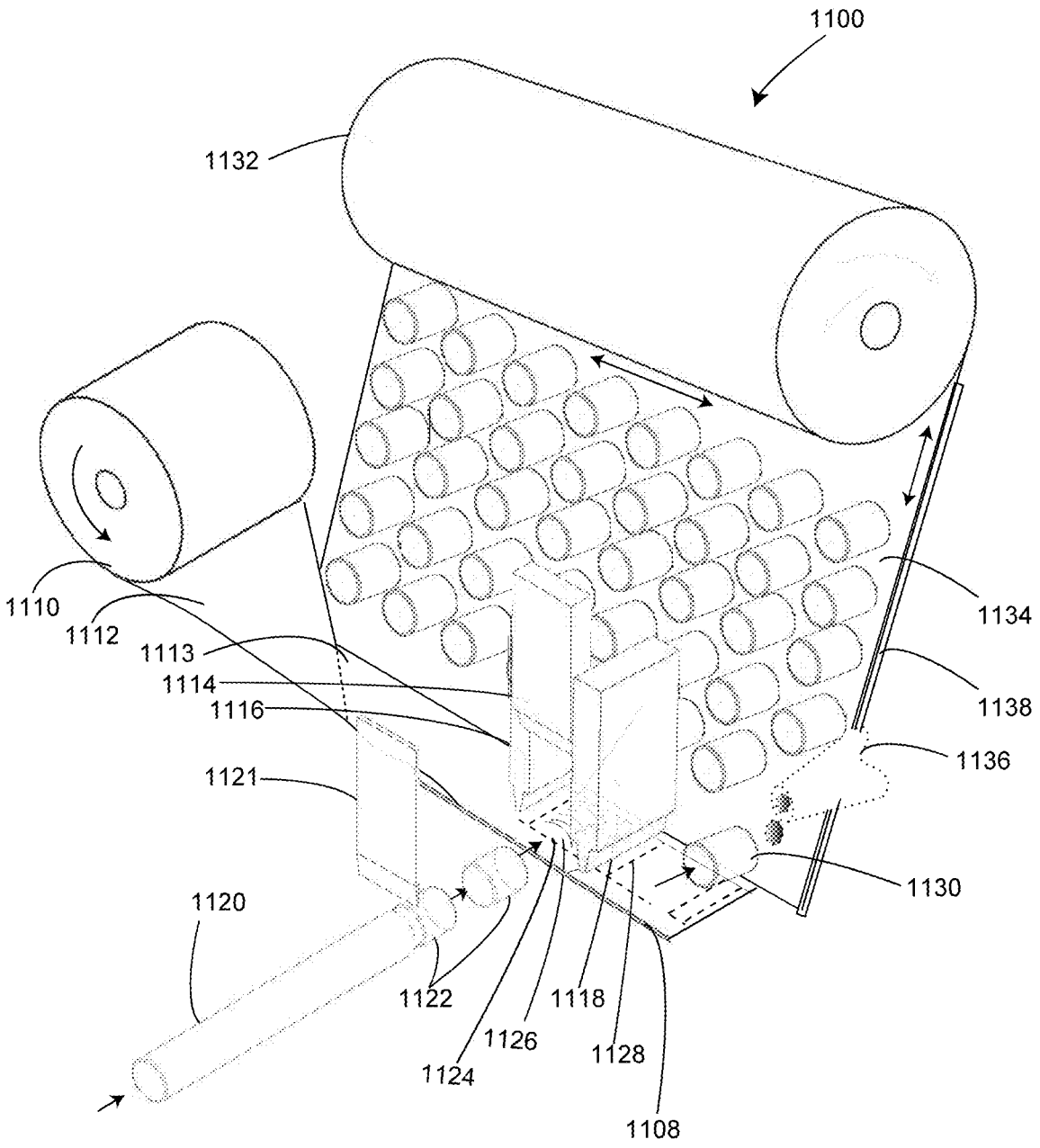
FIG. 23 is a view of a machine for fabricating a layer of cushion pockets.

Referring to FIG. 23, where a machine 1100 according to another embodiment of the present invention is shown for fabricating individual pocket cushions 1130, and attaching them to an attachment layer 1134 fed from an attachment roll 1132. Machine 1100 generally comprises a base conveyor 1108 adapted to support and move multiple layers of fabric to various forming and cutting stations, and an attachment layer conveyor 1138 adapted to move attachment layer fabric 1134. Machine 1100 further comprises a fabric roll 1110 comprising an unfolded fabric 1112 that goes through anyone of a known fabric folded mechanism and comes out folded fabric 1113. Fabric roll 1110 feeds fabric 1112 into a known folding mechanism and onto base conveyor 1108. Many fabrics can be used in this invention, including but not limited to, woven fabrics such as cotton, polyester, polypropylene, nylon, and fabric blends, along with non-woven fabrics composed of polyester, polypropylene, nylon, and fabric blends. Forming the sides of cushion pocket 1126 is a cushion pocket delineation line 1128 formed by an ultrasonic bonding horn 1116. In this embodiment, all delineation lines are done via ultrasonic welding and ultrasonic welding horns. However, it is envisioned that other types of bonding apparatuses and bonding horns, such as thermal bonding with thermal bonding horns and thermally bondable fabrics could also be used. Foam cushion cylinder 1122 is compressed by any one of a number of known means, is inserted in the correct final orientation into the cushion pocket 1126. We maintain the correct orientation of foam cushion cylinder 1122 through its insertion since the potential energy stored within the compressed foam cushion cylinder 1122 is not sufficient to allow the cushion cylinder to correct its orientation if it was not in the correct orientation to start with. Another unique aspect of this invention is the cutting of the individual foam cushion cylinders 1122 from a longer foam cylinder 1120 by a cutting knife 1121. The method further comprises the step of slicing an individual length of foam from the cylindrical tube 1120 of cushioning material prior to inserting into the pocket. This allows us to pre-program and vary the size of each cushion foam cylinder. In so doing this we can zone various areas of the cushion pocket attachment layer with different size foam cushion pockets 1130. It is also envisioned, that different resilience foam cylinders 1120 could be utilized to make a single cushion pocket attachment layer, thereby creating a zoned cushion pocket attachment layer. It should be noted that knife 1121 can be, but is not limited to, a shearing knife, a hot knife, or an ultrasonic cutting knife or any other cutting device or method. A big advantage of using long foam cylinder 1120 in the assembly is that it insures that foam cushion cylinder 1122 will always be in the correct orientation relative to cushion pocket 1126. The method further comprises the step of using a compression set of jaws to pre-compress the foam so that it easily inserts into the pocket and maintains its final orientation in the insertion process. Alternatively, using a compression set of jaws to pre-compress the end of the foam cylinder and inserting the foam cylinder into the pre-made fabric pocket, and cutting the foam after insertion to create an individual foam cylinder in the fabric pocket. After foam cushion cylinder 1122 is placed in cushion pocket 1126, ultrasonic bonding horn 1114 forms a delineation line that seals the cushion pocket 1126. The folded fabric 1113 now advances to the pocket cushion spring cutoff station. For purposes of this illustration, and to better show the entire process, the top piece of the folded fabric 1113 is removed from this illustration after the formation of the initial cushion pocket 1126. As the folded fabric 1113 continues to advance on conveyor 1108, cushion pocket 1126 is separated from the advancing folded fabric 1113 by an ultrasonic cutoff horn 1118. After the completed pocket cushion 1130 is formed, it is pushed towards the attachment layer 1134 and the attachment layer conveyor 1138. In this embodiment, an adhesive applicator 1136 lays down an adhesive layer between the pocket cushion 1130 and the attachment layer 1134. It should be obvious to anyone skilled in the art that other means of attaching the pocket cushion 1130 to the attachment layer 1134 are possible. These can include, but are not limited to ultrasonic welding and hot melt adhesive. The entire attachment layer 1134, and attachment layer conveyor 1138 are movable in the two axes of the attachment layer 1134 material plane to allow the pocket cushion 1130 to be attached at any prescribed location on the attachment layer 1134.

Figure 24:
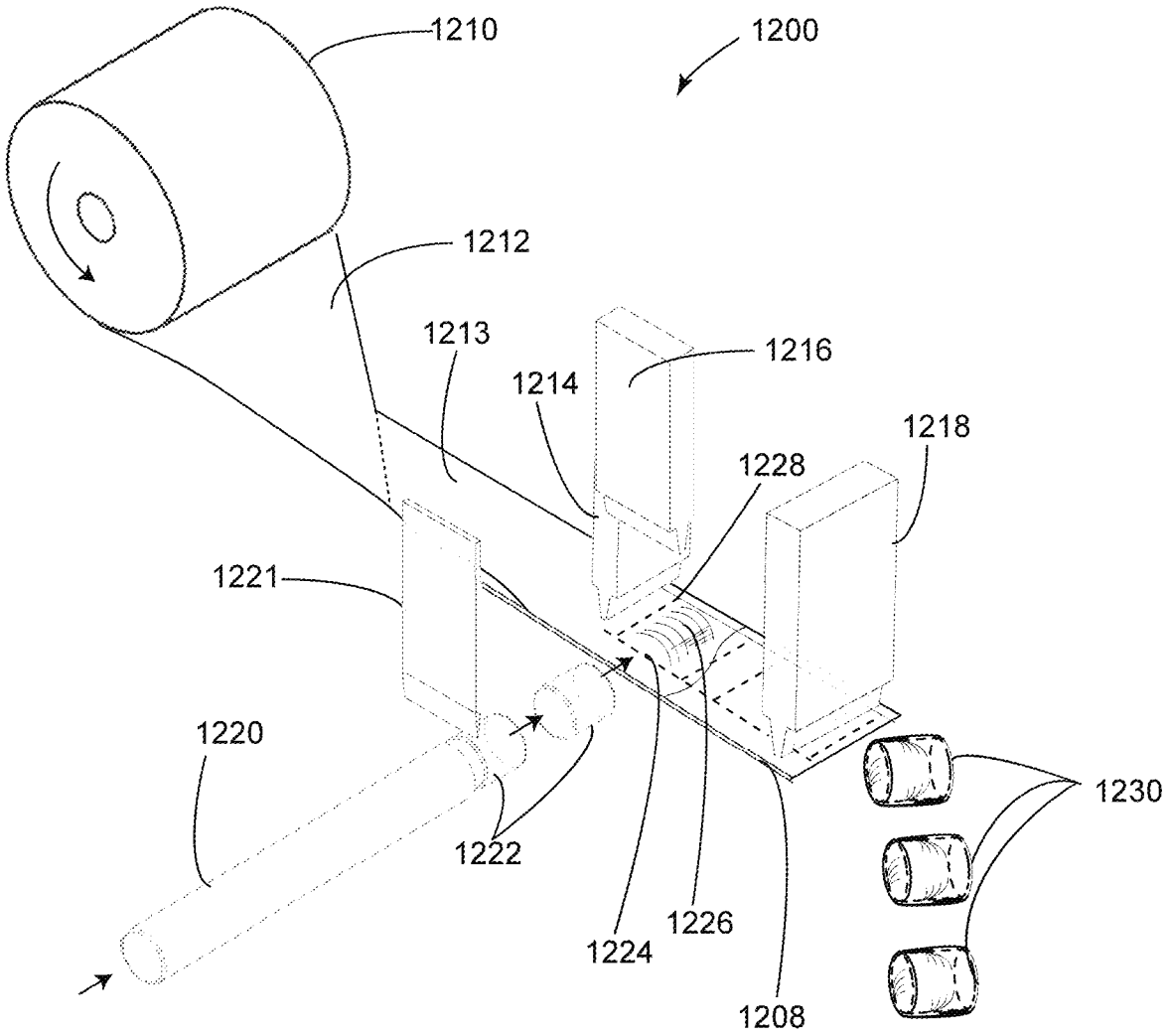
FIG. 24 is a view a machine for fabricating a cushion pocket.

Referring to FIG. 24, where a machine 1200 according to another embodiment of the present invention is shown for fabricating individual pocket cushions 1230. Machine 1200 generally comprises a base conveyor 1208 adapted to support and move multiple layers of fabric to various forming and cutting stations. Machine 1200 further comprises a fabric roll 1210 comprising an unfolded fabric 1212 that goes through anyone of a known fabric folded mechanism and comes out folded fabric 1213. Fabric roll 1210 feeds fabric 1212 into a known folding mechanism and onto base conveyor 1208. Many fabrics can be used in this invention, including but not limited to, woven fabrics such as cotton, polyester, polypropylene, nylon, and fabric blends, along with non-woven fabrics composed of polyester, polypropylene, nylon, and fabric blends. Forming the sides of cushion pocket 1226 is a cushion pocket delineation line 1228 formed by an ultrasonic bonding horn 1214. In this embodiment, all delineation lines are done via ultrasonic welding and ultrasonic welding horns. However, it is envisioned that other types of bonding apparatuses and bonding horns, such as thermal bonding with thermal bonding horns and thermally bondable fabrics could also be used. Foam cushion cylinder 1222 is compressed by any one of a number of known means, is inserted in the correct final orientation into the cushion pocket 1226. We maintain the correct orientation of foam cushion cylinder 1222 through its insertion since the potential energy stored within the compressed foam cushion cylinder 1222 is not sufficient to allow the cushion cylinder to correct its orientation if it was not in the correct orientation to start with. Another unique aspect of this invention is the cutting of the individual foam cushion cylinders 1222 from a longer foam cylinder 1220 by a cutting knife 1221. The method further comprises the step of slicing an individual length of foam from the cylindrical tube 1220 of cushioning material prior to inserting into the pocket. It should be noted that knife 1221 can be, but is not limited to, a shearing knife, a hot knife, or an ultrasonic cutting knife or any other cutting device or method. A big advantage of using long foam cylinder 1220 in the assembly is that it insures that foam cushion cylinder 1222 will always be in the correct orientation relative to cushion pocket 1226. The method further comprises the step of using a compression set of jaws to pre-compress the foam so that it easily inserts into the pocket and maintains its final orientation in the insertion process. Alternatively, using a compression set of jaws to pre-compress the end of the foam cylinder and inserting the foam cylinder into the pre-made fabric pocket, and cutting the foam after insertion to create an individual foam cylinder in the fabric pocket. After foam cushion cylinder 1222 is placed in cushion pocket 1226, ultrasonic bonding horn 1216 forms a delineation line that seals the cushion pocket 1226. The folded fabric 1213 now advances to the pocket cushion spring cutoff station. For purposes of this illustration, and to better show the entire process, the top piece of the folded fabric 1213 is removed from this illustration after the formation of the initial cushion pocket 1226. As the folded fabric 1213 continues to advance on conveyor 1208, cushion pocket 1226 is separated from the advancing folded fabric 1213 by an ultrasonic cutoff horn 1218. After the completed pocket cushion 1230 is formed it is deposited into a hopper (not shown) and can be later used in an assembly machine to create a pocket cushion attachment layer.

Figure 25:
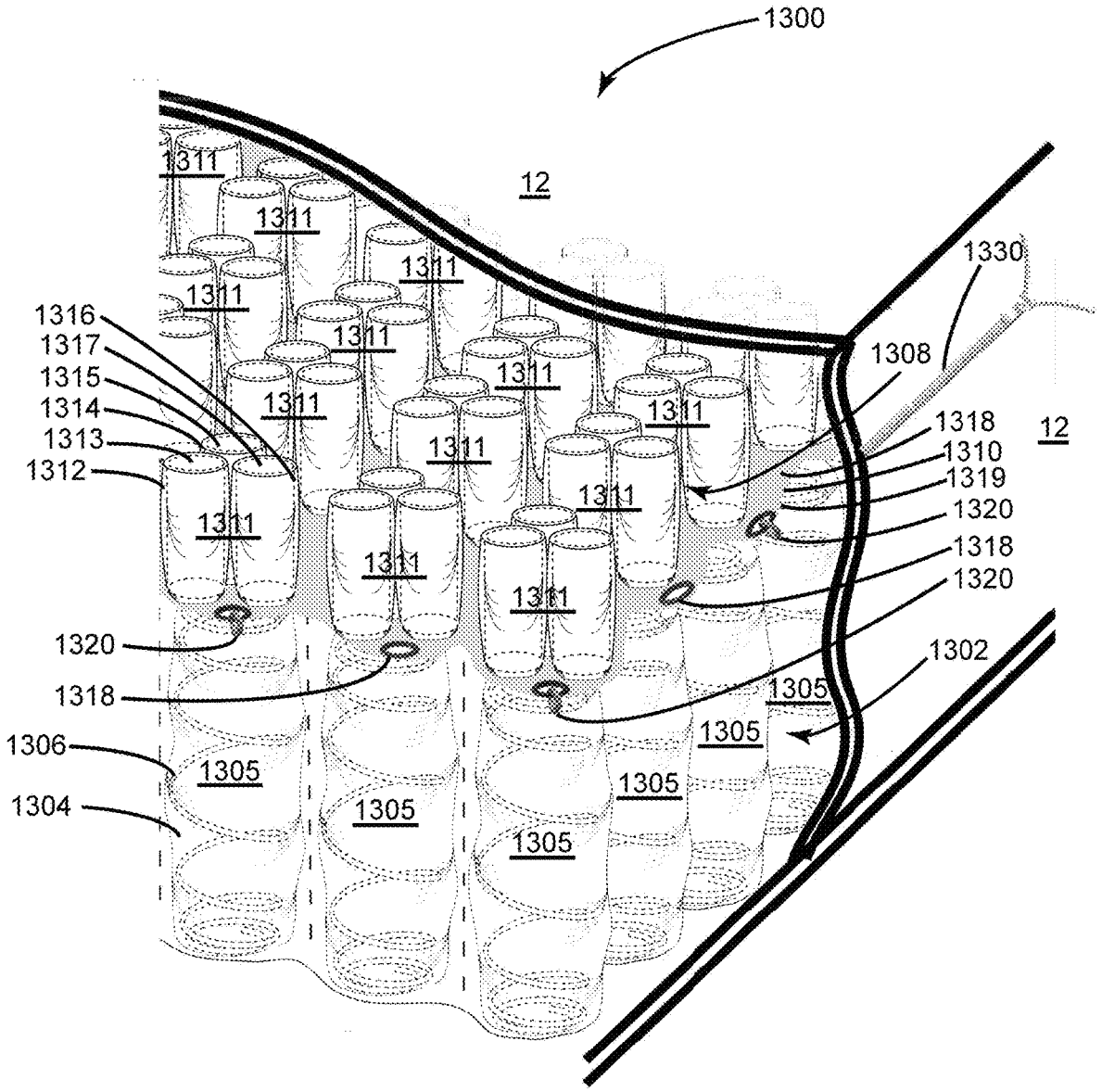
FIG. 25 is a view of a single sided mattress according to another embodiment of the invention showing, in an unloaded state, a layer of micro cushion pockets removably engaged with a layer of coil pockets.

Referring to FIG. 25, where in another embodiment, a mattress 1300 comprises an upper layer of micro cushion pockets 1308 attached to the top layer of coil pockets 1302 by mechanical clips 1320 that are inserted through a grommet 1318, and through the coil spring 1306. As in FIG. 13, the micro cushion pocket arrays 1311 are bonded to an attachment member 1310 upper layer 1318, that in this embodiment is a fabric sheet made from a material having quasi-isotropic properties. It should be noted that the upper layer of micro cushion pockets 1308 is separate and distinct from the layer of coil pockets 1302. Also, as in FIG. 13, the spacing and location of the micro cushion pocket array 1311 is such that each micro cushion pocket array 1311 is located directly above a coil pocket 1305 that it is directly acting upon. In this embodiment micro cushion array 1311 is made up of three different micro cushions each having a different or same resiliency R. One of the micro cushion of micro cushion array 1311 has a fabric pocket 1312 that encases a foam element 1313 of resilience R1. A second micro cushion of micro cushion array 1311 has a fabric pocket 1314 that encases a foam element 1315 of resilience R2. A third micro cushion of micro cushion array 1311 has a fabric pocket 1316 that encases a foam element 1317 of resilience R3. With these three different foam element resiliencies R1, R2, R3 making up the cushioning elements of micro cushion array 1311, we can achieve a variable rate cushioning that has different softness's depending on how hard and fast you depress the cushion elements. It is also possible for fabric pocket 1312 to have a different and unique geometry than that of either fabric cushion pocket 1314, or fabric cushion pocket 1316. Based on the different geometries of the cushion pockets, R1 of cushion pocket 1312 can be different than R2 of cushion pocket 1314 that is different than R3 of 1316, thereby creating a multi-rate micro cushion assembly. Although one type of clip and grommet combination is shown, it should be obvious to anyone who is skilled in the art that other forms of mechanical clips, that can clamp onto the fabric attachment layer 1310, and mechanically clamp onto the coil pocket 1304 and encased coil spring 1306 are also feasible. With such mechanical clamping devices, the need to provide grommets 1318 on the attachment layer 1310 may be eliminated. All of the benefits that are described in the description of the embodiment of FIG. 13 are available in this embodiment. Additionally, by the use of a mechanical fastener 1320, a manufacturer, a retail establishment, or end user can easily attach, or remove, a layer of micro cushion pockets 1308, from a layer of coil pockets 1302 by an attachment member 1310. The ability to add or remove the upper layer of micro cushion pockets 1308 affords a manufacturer considerably greater manufacturing flexibility when fabricating a mattress. For instance, the manufacturer can reduce his mattress component inventory and just stock a few skews of pocket coil units, along with an assortment of cushion pocket layers, and mix and match these two components during assembly to create a multitude of mattress models. For the retail establishment, the ability to change cushion pocket layers in short order allows the store to keep one demonstration unit, that has a layer of coil springs 1302, inside a mattress covering 12, that can be accessed by unzipping the mattress cover 12 with zipper 1330, thereby allowing the establishment to change out the micro cushion layer 1308 to demonstrate a multitude of different comfort levels. Additionally, the retailer can customize a mattress to a customer's exact comfort preference by mixing an matching different micro cushion pocket layers 1308 with a pocket coil layer 1302. At the same time, an end user who might decide to change the mattresses comfort level at a future date, can potentially remove the cushion pocket layer 1308 by releasing mechanical clips 1320, and replace the cushion pocket layer 1308 with one that has a different cushion member comfort level.

Figure 26:
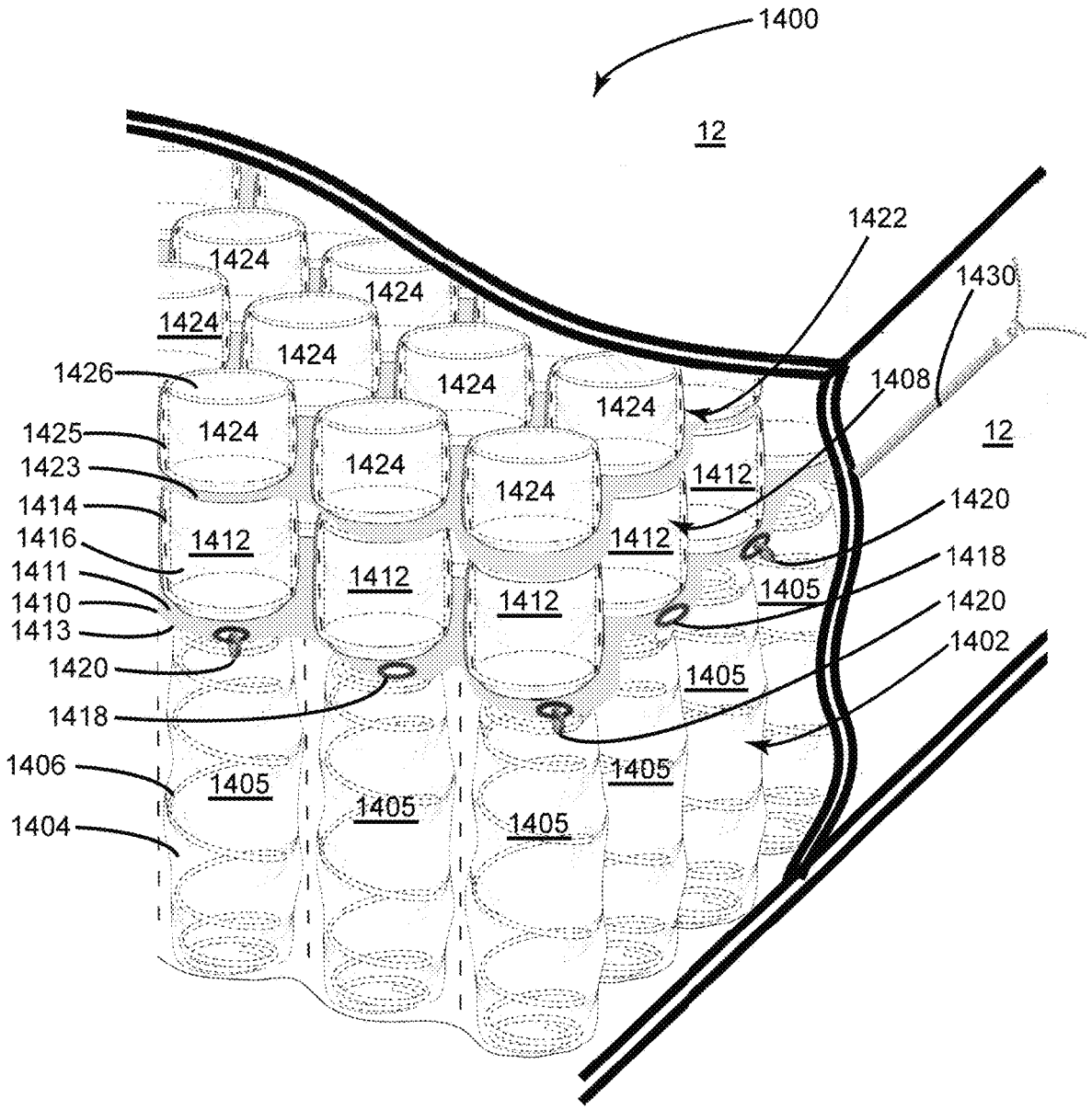
FIG. 26 is a view of a single sided mattress according to another embodiment of the invention showing, in an unloaded state, a first layer of micro cushion pockets removably engaged with a layer of coil pockets and a second layer of micro cushion pockets secured to the top of the first layer of micro cushion pockets.

Referring to FIG. 26, where in another embodiment, a mattress 1400 comprises an upper layer of cushion pockets 1408 attached to the top layer of coil pockets 1402 by mechanical clips 1420 that are inserted through a grommet 1418, and through the coil spring 1406. As in FIG. 13, the cushion pockets 1412 are bonded to an attachment member 1410, that in this embodiment is a fabric sheet made from a material having quasi-isotropic properties. Also, as in FIG. 13, the spacing and location of the cushion pocket 1412 is such that each cushion pocket 1412 is located directly above a coil pocket 1405 that it is directly acting upon. The upper layer of cushion pockets 1408 is separate and distinct from the layer of coil pockets 1402. Upper layer of cushion pockets 1408 comprises an attachment member 1410 having lower and upper surfaces 1413 and 1411, respectively, and a plurality of cushion pockets 1412 secured to upper surface 1411. Although one type of clip and grommet combination is shown, it should be obvious to anyone who is skilled in the art that other forms of mechanical clips, that can clamp onto the fabric attachment layer 1410, and mechanically clamp onto the coil pocket 1404 and encased coil spring 1406 are also feasible. With such mechanical clamping devices, the need to provide grommets 1418 on the attachment layer 1410 may be eliminated. All of the benefits that are described in the description of the embodiment of FIG. 13 are available in this embodiment. Additionally, by the use of a mechanical fastener 1420, a manufacturer, a retail establishment, or end user can easily attach, or remove, a layer of cushion pockets 1408, from a layer of coil pockets 1402 by an attachment member 1410. In addition, a second cushion pocket layer 1422 is composed of cushion pockets 1424 that are bonded to an attachment layer 1423 that resides directly above cushion layer 1408 such that every cushion pocket 1424 is directly engaged, and directly acting upon, a corresponding cushion pocket 1412 on cushion layer 1408. In this embodiment, cushion layer 1422, through it's attachment layer 1423 is directly bonded via adhesive to coil layer 1408. However, it is also envisioned that other bonding means, such as but not limited to mechanical bonding might also be used. The ability to add or remove the upper layer of cushion pockets 1408 and 1422 affords a manufacturer considerably greater manufacturing flexibility when fabricating a mattress. For instance, the manufacturer can reduce his mattress component inventory and just stock a few skews of pocket coil units, along with an assortment of cushion pocket layers, and mix and match these two components during assembly to create a multitude of mattress models. For the retail establishment, the ability to change cushion pocket layers in short order allows the store to keep one demonstration unit, that has a layer of coil springs 1402, inside a mattress covering 12, that can be accessed by unzipping the mattress cover 12 with zipper 1430, thereby allowing the establishment to change out the cushion layer 1408 and 1422 to demonstrate a multitude of different comfort levels. Additionally, the retailer can customize a mattress to a customer's exact comfort preference by mixing an matching different cushion pocket layers 1408 and 1422 with a pocket coil layer 1402. The ability to stack multiple cushion layers, potentially mixing and matching different layers with different pocket spring coils affords a manufacturer greater product flexibility while requiring only minimum raw material components.

Figure 27:
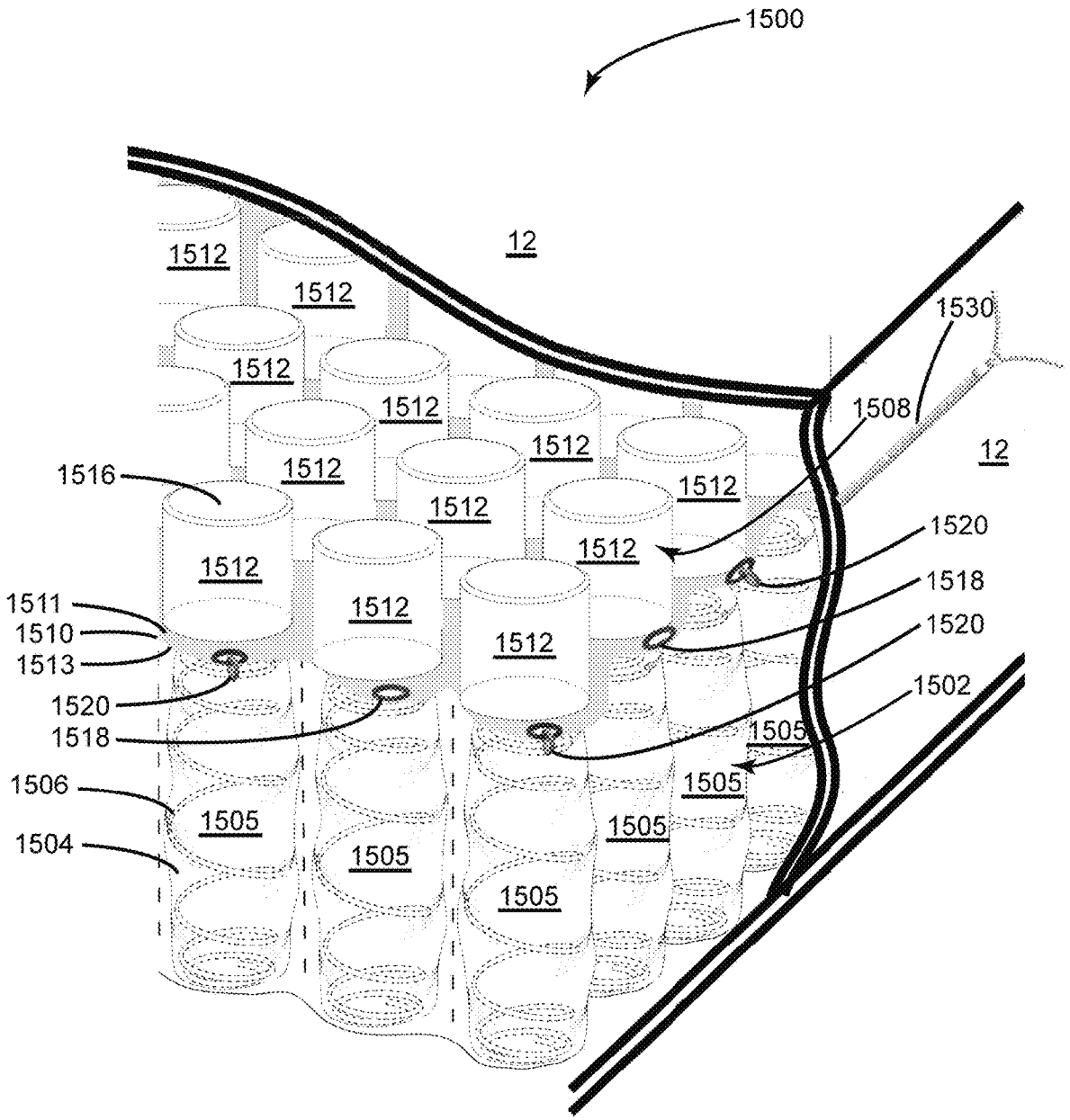
FIG. 27 is a view of a single sided mattress according to another embodiment of the invention showing, in an unloaded state, a layer of cushion members engaged with a layer of coil pockets.

Referring to FIG. 27, where in another embodiment, a mattress 1500 comprises an upper layer of cushions 1508 attached to the top layer of coil pockets 1502 by mechanical clips 1520 that are inserted through a grommet 1518, and through the coil spring 1506. As in FIG. 13, the cushions 1512 are bonded to an attachment member 1510, that in this embodiment is a fabric sheet made from a material having quasi-isotropic properties. Also, as in FIG. 13, the spacing and location of cushions 1512 is such that each cushion is located directly above a coil pocket 1505 that it is directly acting upon. In this embodiment, the foam cushion element 1516 is not encased in a pocket fabric but instead bonded directly to the upper surface 1511 of the attachment layer 1510. It should be noted that the upper layer of cushions 1508 is separate and distinct from the layer of coil pockets 1502. Although one type of clip and grommet combination is shown, it should be obvious to anyone who is skilled in the art that other forms of mechanical clips, that can clamp onto the fabric attachment layer 1510, and mechanically clamp onto the coil pocket 1504 and encased coil spring 1506 are also feasible. With such mechanical clamping devices, the need to provide grommets 1518 on the attachment layer 1510 may be eliminated. All of the benefits that are described in the description of the embodiment of FIG. 13 are available in this embodiment. Additionally, by the use of a mechanical fastener 1520, a manufacturer, a retail establishment, or end user can easily attach, or remove, a layer of cushions 1508, from a layer of coil pockets 1502 by an attachment member 1510. The ability to add or remove the upper layer of cushion pockets 1508 affords a manufacturer considerably greater manufacturing flexibility when fabricating a mattress. For instance, the manufacturer can reduce his mattress component inventory and just stock a few skews of pocket coil units, along with an assortment of cushion layers, and mix and match these two components during assembly to create a multitude of mattress models. For the retail establishment, the ability to change cushion layers in short order allows the store to keep one demonstration unit, that has a layer of coil springs 1502, inside a mattress covering 12, that can be accessed by unzipping the mattress cover 12 with zipper 1530, thereby allowing the establishment to change out the cushion layer 1508 to demonstrate a multitude of different comfort levels. Additionally, the retailer can customize a mattress to a customer's exact comfort preference by mixing an matching different cushion layers 1508 with a pocket coil layer 1502. At the same time, an end user who might decide to change the mattresses comfort level at a future date, can potentially remove the cushion layer 1508 by releasing mechanical clips 1520, and replace the cushion layer 1508 with one that has a different cushion member 1516 resilience.

Figure 28:
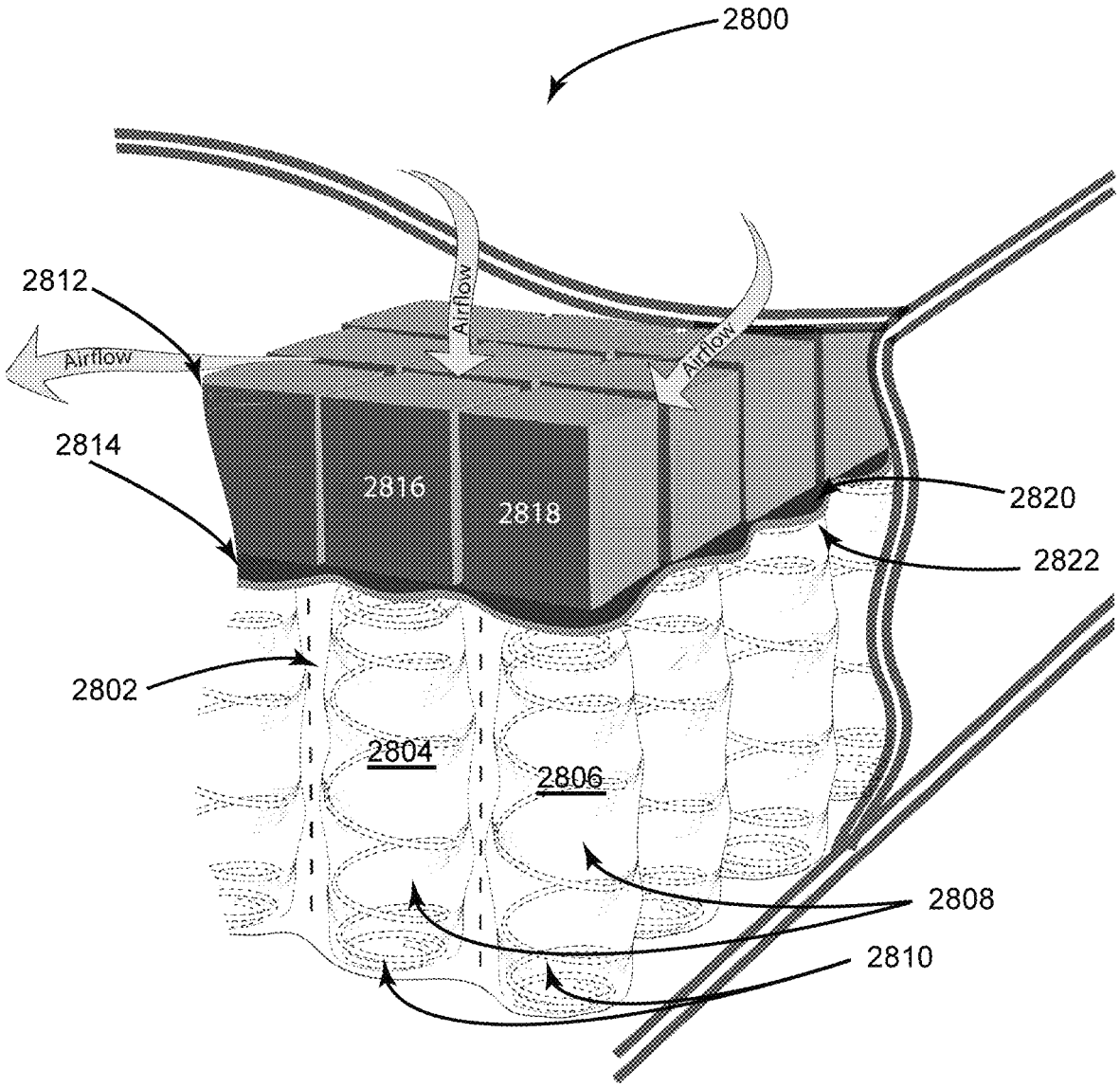
FIG. 28 is a view of a single sided mattress according to another embodiment of the invention showing, in an unloaded state, a layer of cushion members engaged with a layer of coil pockets by an attachment member.

Referring to FIG. 28, where in another embodiment according to the present invention, a mattress 2800 comprises a layer of coil pockets 2802 comprising first and second coil pockets 2804 and 2806. Each of first and second coil pockets 2804 and 2806 comprise a pocket 2808 and a coil spring 2810 disposed in pocket 2808. Mattress 2800 further comprises a first layer of cushion members 2812 comprising an attachment member 2814 and first and second cushion members 2816 and 2818 attached to attachment member 2814. Attachment member 2814 comprising an upper surface 2820 and a lower surface 2822. First and second cushion members 2816 and 2818 are engaged with upper surface 2820 of attachment member 2814. Lower surface 2822 of attachment member 2814 is engaged with layer of coil pockets 2802 such that first and second cushion members 2816 and 2818 act directly upon first and second coil pockets 2804 and 2806, respectively. First cushion member 2816 is free standing from second cushion member 2818 thereby causing a pumping action to occur upon depression of first cushion member 2816 and circulation of air. Pocket 2808, coil spring 2810, first and second cushion members 2816 and 2818, and attachment member 2814 may be made from materials and processes as previously described herein.

Figure 29:
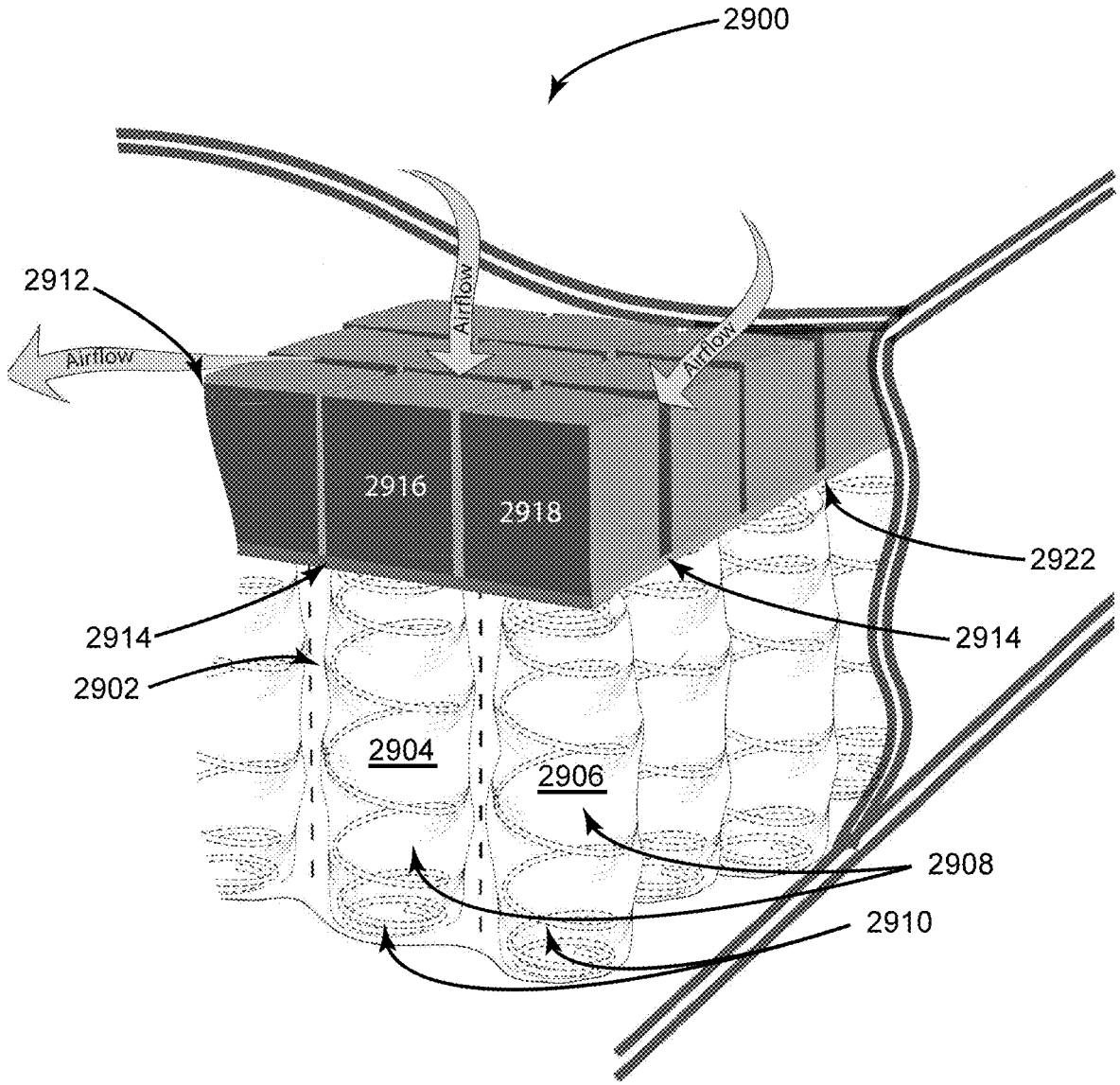
FIG. 29 is a view of a single sided mattress according to another embodiment of the invention showing, in an unloaded state, a layer of cushion members formed with an attachment member engaged with a layer of coil pockets.

Referring to FIG. 29, wherein where in another embodiment according to the present invention, a mattress 2900 comprises a layer of coil pockets 2902 comprising first and second coil pockets 2904 and 2906. Each of first and second coil pockets 2904 and 2906 comprise a pocket 2908 and a coil spring 2910 disposed in pocket 2908. Mattress 2900 further comprises a first layer of cushion members 2912 comprising an attachment member 2914 and first and second cushion members 2916 and 2918 formed as part of attachment member 2914. Lower surface 2922 of attachment member 2914 is engaged with layer of coil pockets 2902 such that first and second cushion members 2916 and 2918 act directly upon first and second coil pockets 2904 and 2906, respectively. First cushion member 2916 is free standing from second cushion member 2918 thereby causing a pumping action to occur upon depression of first cushion member 2916 and circulation of air. Pocket 2908, coil spring 2910, first and second cushion members 2916 and 2918, and attachment member 2914 may be made from materials and processes as previously described herein.

While particular embodiments of the invention have been shown and described, it will be obvious to those skilled in the art that changes and modifications may be made without departing from the scope of the claimed invention.

What is claimed:

1. A mattress comprising:

a layer of coil pockets comprising first and second coil pockets; each of said first and second coil pockets comprising a pocket and a coil spring disposed in said pocket; and a first layer of cushion members comprising an attachment member and first and second cushion members engaged with said attachment member; said attachment member being engaged with said layer of coil pockets such that said first and second cushion members act directly upon said first and second coil pockets, respectively; said first cushion member is free standing from said second cushion member thereby causing a pumping action to occur upon depression of said first cushion member and circulation of air.

2. The mattress of claim 1, wherein said attachment member comprises an upper surface and a lower surface; said first and second cushion members being engaged with said upper surface of said attachment member.

3. The mattress of claim 2, wherein said pocket of each of said first and second coil pockets are made from fabric.

4. The mattress of claim 3, wherein said attachment member is a fabric sheet.

5. The mattress of claim 4, wherein each of said first and second cushion members are made from foam.

6. The mattress of claim 5, wherein each of said first and second cushion members are connected to said attachment member by adhesive.

7. The mattress of claim 6, wherein said coil spring of each of said first and second coil pockets is a multi-rate coil spring.

8. The mattress of claim 1, wherein said first and second cushion members are formed with said attachment member.

9. The mattress of claim 8, wherein said first and second cushion members and said attachment member are made from a single piece of foam.

10. A pocket spring unit comprising a layer of coil pockets comprising first and second coil pockets and a first layer of cushion members comprising an attachment member and first and second cushion members engaged with said attachment member; said attachment member being engaged with said layer of coil pockets such that said first and second cushion members act directly upon said first and second coil pockets, respectively; said pocket of said first cushion member is free standing from said second cushion member thereby causing a pumping action to occur upon depression of said first cushion pocket and circulation of air.

11. The mattress of claim 10, wherein said attachment member comprises an upper surface and a lower surface; said first and second cushion members being engaged with said upper surface of said attachment member.

12. The pocket spring unit of claim 11, wherein said pocket of each of said first and second coil pockets are made from a piece of fabric.

13. The pocket spring unit of claim 12, wherein said attachment member is a fabric sheet.

14. The pocket spring unit of claim 13, wherein each of said first and second cushion members are made from foam.

15. The pocket spring unit of claim 14, wherein each of said first and second cushion members are connected to said attachment member by adhesive.

16. The pocket spring unit of claim 15, wherein said coil spring of each of said first and second coil pockets is a multi-rate coil spring.

17. The pocket spring unit of claim 10, wherein said first and second cushion members are formed with said attachment member.

18. The pocket spring unit of claim 17, wherein said first and second cushion members and said attachment member are made from a single piece of foam.

* * * * *